US007552686B2

(12) United States Patent
Fisher

(10) Patent No.: US 7,552,686 B2
(45) Date of Patent: Jun. 30, 2009

(54) ADJUSTABLE PORTABLE TABLE APPARATUS

(76) Inventor: Scott E. Fisher, 7860 E. Camino Los Brazos, Tucson, AZ (US) 85750

( * ) Notice: Subject to any disclaimer, the term of this patent is extended or adjusted under 35 U.S.C. 154(b) by 549 days.

(21) Appl. No.: 11/340,921

(22) Filed: Jan. 27, 2006

(65) Prior Publication Data

US 2006/0162622 A1 Jul. 27, 2006

Related U.S. Application Data

(63) Continuation-in-part of application No. 11/046,612, filed on Jan. 27, 2005.

(51) Int. Cl.
*A47B 23/00* (2006.01)

(52) U.S. Cl. ..... 108/44; 224/509

(58) Field of Classification Search ..... 108/44, 108/45; 296/26.09, 26.08; 224/404, 521, 224/519, 518, 524, 527, 314; 135/16
See application file for complete search history.

(56) References Cited

U.S. PATENT DOCUMENTS 5,397,147 A 3/1995 Ducharme et al.
5,460,304 A * 10/1995 Porter et al. ..... 224/521
5,518,159 A * 5/1996 DeGuevara ..... 224/488
5,649,656 A * 7/1997 Davy ..... 224/405
5,752,639 A * 5/1998 Rice ..... 224/521
5,788,135 A * 8/1998 Janek ..... 224/527
5,820,004 A * 10/1998 Lane ..... 224/485
5,842,615 A * 12/1998 Goodness ..... 224/509
5,857,741 A * 1/1999 Anderson ..... 108/44
5,938,092 A * 8/1999 Johnson ..... 224/521
5,950,617 A * 9/1999 Lorenz ..... 108/44
6,082,269 A * 7/2000 Padberg ..... 108/44
6,126,053 A * 10/2000 Shaver ..... 224/509
6,164,508 A * 12/2000 van Veenen ..... 224/509
6,189,458 B1 * 2/2001 Rivera ..... 108/44
6,314,891 B1 * 11/2001 Larson ..... 108/44
6,336,413 B1 * 1/2002 Ball ..... 108/44
6,443,345 B1 * 9/2002 Bloemer et al. ..... 224/519
6,511,088 B2 * 1/2003 Kahlstorf ..... 280/415.1
6,662,983 B2 * 12/2003 Lane et al. ..... 224/405
6,722,380 B1 * 4/2004 Hafer ..... 135/16
6,739,269 B1 * 5/2004 Benton ..... 108/44
6,752,088 B2 * 6/2004 Poarch et al. ..... 108/44
6,808,231 B1 * 10/2004 Hill ..... 296/26.09
6,902,088 B2 * 6/2005 Carey ..... 224/519
6,929,163 B1 * 8/2005 Pedrini et al. ..... 224/519
7,073,857 B1 * 7/2006 Bailey ..... 297/217.7
7,284,586 B2 * 10/2007 Howland ..... 224/42.12
2003/0057244 A1 3/2003 Dorety
2005/0241546 A1 11/2005 Royse

OTHER PUBLICATIONS

Travel Mate, Quadratic, Summer 1999, p. 22.

* cited by examiner

*Primary Examiner*—José V Chen
(74) *Attorney, Agent, or Firm*—Dale F. Regelman; Quarles & Brady LLP

(57) ABSTRACT

A portable table apparatus is disclosed, where that apparatus can be releaseably attached to a vehicle. The apparatus comprises an adjustable horizontal assembly, one or more storage containers attached to that horizontal assembly, a vertical assembly, and a table.

12 Claims, 23 Drawing Sheets

ADJUSTABLE PORTABLE TABLE APPARATUS

RELATED APPLICATIONS

This application is a Continuation-In-Part of the pending Application having Ser. No. 11/046,612 Jan. 27, 2005.

FIELD OF THE INVENTION

The invention is directed to an adjustable portable table apparatus. In certain embodiments, Applicant's adjustable portable table apparatus further includes an adjustable-height umbrella assembly.

BACKGROUND OF THE INVENTION

The prior art teaches use of tables that can attach to the back of a vehicle using a trailer hitch assembly. Applications for such a table apparatus includes recreational uses and commercial uses. Such recreational uses include, example, hunting trips, camping trips, tailgate parties, and the like. Commercial uses include, for example, construction sites, utility installation sites, and the like.

Prior art devices, however, are generally suited for use with one vehicle, or one type of vehicle, and then only for either recreational use or commercial use. What is needed is a portable table assembly wherein certain dimensions of that apparatus can be adjusted, such that the portable table assembly can be used with a variety of vehicles, both recreationally and commercially.

SUMMARY OF THE INVENTION

Applicant's invention comprises an adjustable portable table assembly which can be releaseably attached to a vehicle. The portable table assembly includes a horizontal assembly comprising a first tubular member having a first end and a second end, where that first end is capable of being releaseably attached to a vehicle, a second member, wherein a portion of that second member is slidingly disposed within the second end of the first tubular member, and a first fixturing means capable of releaseably attaching said second member to said first tubular member, such that the length of the horizontal assembly can be adjusted by increasing or decreasing the length of the second member inserted into the first tubular member.

Applicant's portable table assembly further includes a tubular vertical assembly having a diameter, wherein that tubular vertical assembly comprises a first open end and a second open end, where the second end of the horizontal assembly is releaseably attached to the vertical assembly adjacent the first open end. Applicant's portable table assembly further includes a table formed to include an aperture having the diameter, where that table is releaseably attached to the vertical assembly at the second open end such that the aperture is aligned with the second open end.

Applicant's portable table assembly further includes a second tubular member slidingly disposed around said first tubular member, a storage container comprising a bottom and one or more walls attached to the bottom and extending upwardly therefrom, where the second tubular member is attached to the bottom of the storage container.

BRIEF DESCRIPTION OF THE DRAWINGS

The invention will be better understood from a reading of the following detailed description taken in conjunction with the drawings in which like reference designators are used to designate like elements, and in which:

FIG. 16 shows a front view of Applicant's storage container;

DETAILED DESCRIPTION OF THE PREFERRED EMBODIMENTS

Figure 1:
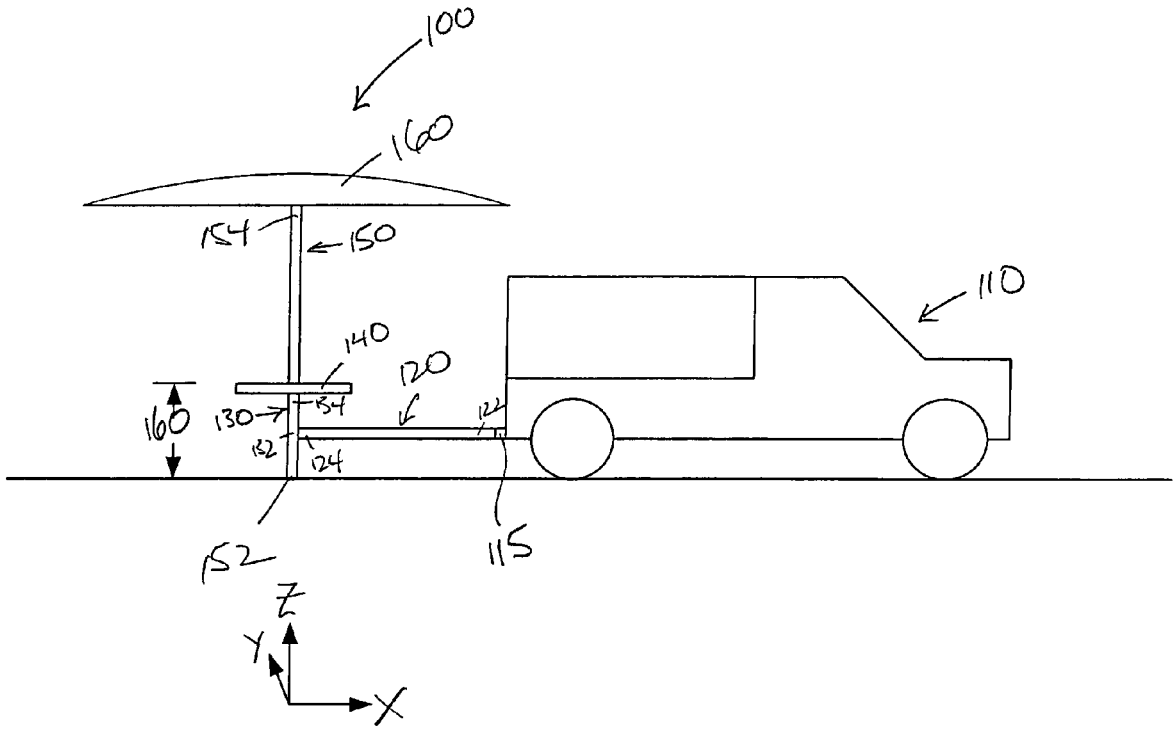
FIG. 1 is a side view of a vehicle releaseably connected to Applicant's portable apparatus which comprises a horizontal assembly, a vertical assembly, a table, and a shelter assembly.

This invention is described in preferred embodiments in the following description with reference to the Figures, in which like numbers represent the same or similar elements. Referring now to FIG. 1, Applicants' invention comprises an apparatus which can be removeably attached to a vehicle, such as vehicle 110, comprising a trailer hitch receiving assembly 115. In the illustrated embodiment of FIG. 1, trailer hitch receiving assembly 115 is disposed on the rear portion of vehicle 110. In other embodiments of Applicant's invention, the trailer hitch receiving assembly 115 may be disposed on the front portion, and/or on a side portion of the vehicle.

In the illustrated embodiment of FIG. 1, vehicle 110 comprises truck. In other embodiments, vehicle 110 comprises a sedan, station wagon, van, sport utility vehicle, recreational vehicles, semi trucks, commercial trucks, 4-wheel motorcycles (Quads), golf Carts and 4-wheel motorized utility carts, and the like. In still other embodiments, vehicle 110 comprises a trailer, i.e. a wheeled-vehicle that does not comprise a motor or engine.

Figure 12A:
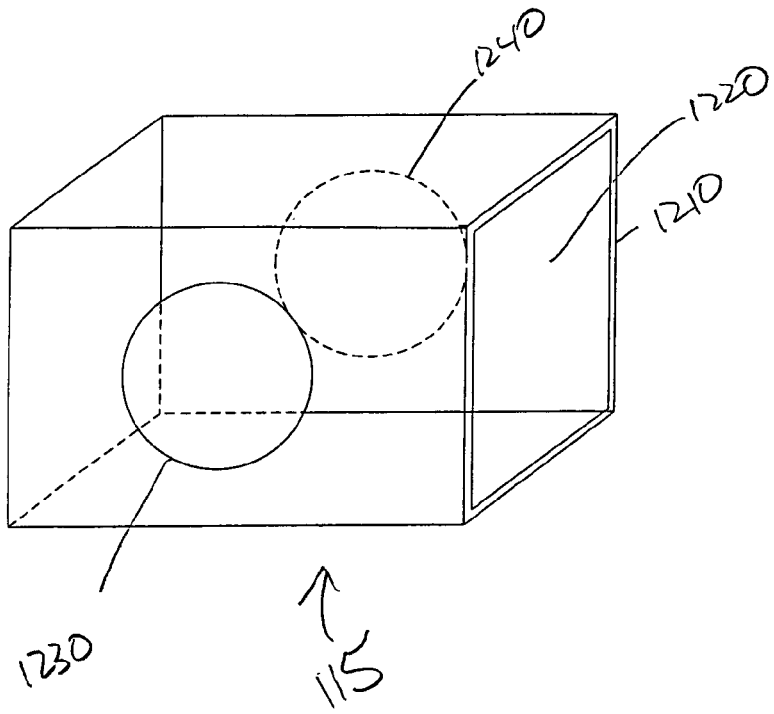
FIG. 12A is a perspective view of a trailer hitch receiving assembly.

Applicant's apparatus comprises assembly 120 which comprises end 122 which can be releaseably engaged with trailer hitch receiving assembly 115 and end 124 which can be releaseably attached to end 132 of assembly 130. FIG. 12A shows a perspective view of trailer hitch receiving assembly 115.

Referring now to FIG. 12A, trailer hitch receiving assembly 115 comprises enclosure 1210 formed to include open end 1220. Assembly 115 is further formed to include aperture 1230 in a first side wall and aperture 1240 in a second, opposing side wall. A trailer hitch which is formed to include a pair of opposing apertures can be inserted into assembly 115, and a crossbolt is then inserted through both apertures in assembly 115 and also through both apertures in the trailer hitch thereby releaseably coupling the trailer hitch to the trailer hitch receiving assembly.

Figure 12B:
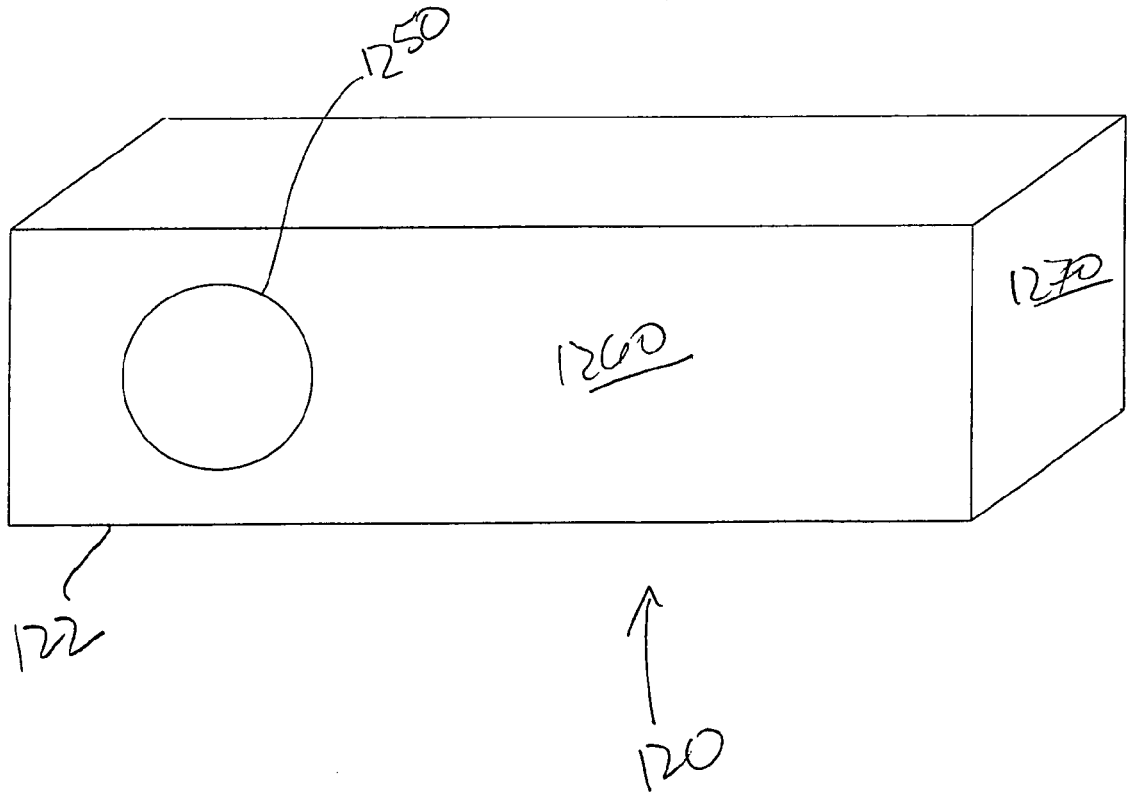
FIG. 12B is a perspective view of a first end of one embodiment of Applicant's horizontal assembly.

Referring now to FIG. 12B, in certain embodiments end 122 of horizontal assembly 120 is formed to include aperture 1250 in wall 1260. In certain embodiments, end 122 of horizontal assembly 120 is formed to include only one aperture, namely aperture 1250 in wall 1260, wherein end 122 is not formed to include a second, opposing aperture in wall 1270. End 122 of horizontal assembly 120 can be inserted into open end 1220 of trailer hitch receiving assembly 115 such that aperture 1250 is aligned with aperture 1230.

Figure 13A:
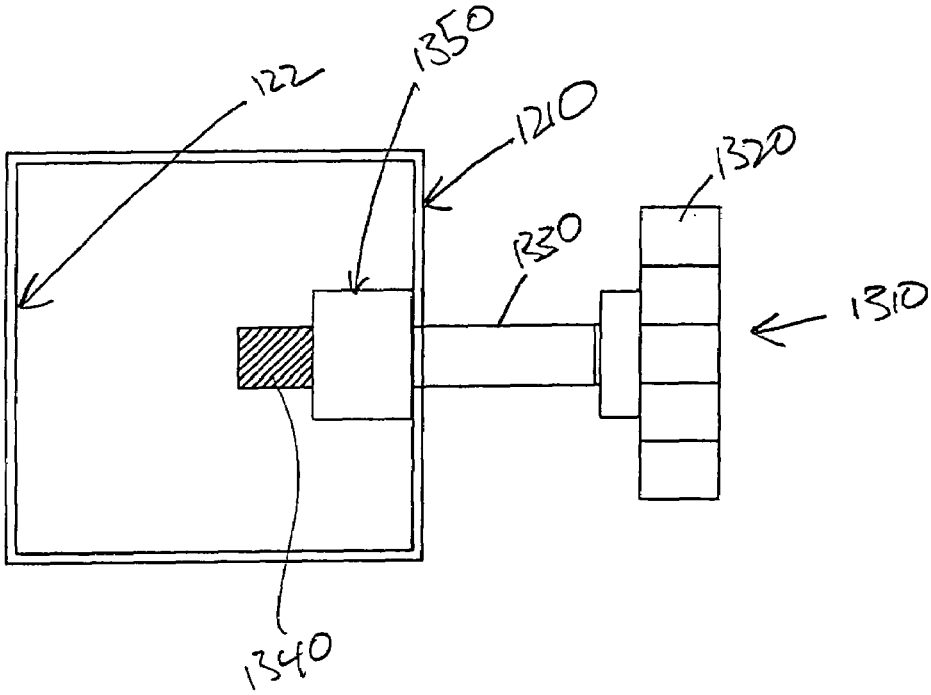
FIG. 13A is a cross sectional view of the first end of FIG. 12B inserted into the trailer hitch receiving assembly of FIG. 12A.
Figure 13B:
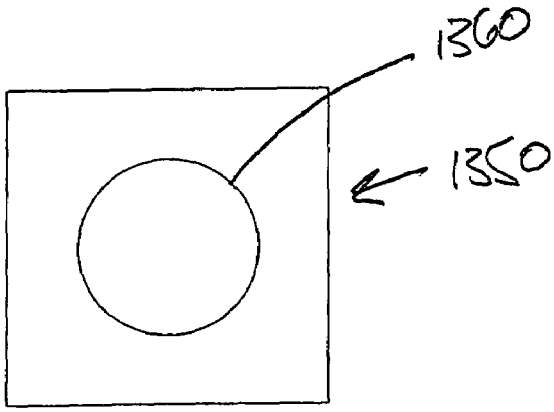
FIG. 13B is a top view of a nut disposed within the first end of FIG. 12B.

Referring now to FIGS. 13A and 13B, in certain embodiments end 122 of horizontal assembly 120 further includes nut 1350 disposed on the interior portion of end 122, wherein nut 1350 is formed to include threaded aperture 1360. Securing means 1310 comprises handle portion 1320 and shaft 1330 which is attached to handle 1320 and extends outwardly therefrom. Distal end 1340 of shaft 1330 is threaded, such that end 1340 can be threadedly engaged with threaded aperture 1360.

In the embodiments of FIGS. 12B, 13A, and 13B, end 122 of horizontal assembly 120 is inserted into trailer hitch receiving assembly 115 such that apertures 1250, 1230, and 1360, are aligned. End 1340 of shaft 1330 is then inserted through aperture 1230 in receiving assembly 115, through aperture 1250 in end 122, to threadedly engage threaded aperture 1360. Rotating handle 1320 releaseably attaches end 122 to assembly 115. Moreover, handle 1320 can be rotated until the releasable attachment of end 122 to assembly 115 has been "snugged tight" such that end 122 cannot wobble at all within assembly 115.

This means of releaseably attaching horizontal assembly 120 to a vehicle provides a secure attachment that permits no movement of horizontal assembly 120. Such a releaseably attachment provides stability to table 140 which is not available if end 122 included a pair of opposing apertures, and a crossbolt was inserted through the opposing apertures in end 122 and in assembly 115.

Referring once again to FIG. 1, table 140 is releaseably attached to end 134 of vertical assembly 130. In certain embodiments, vertical assembly 130 comprises a tubular member having a diameter, a first open end, and a second open end.

In certain embodiments, table 140 is releaseably attached to end 134 of assembly 130. In certain embodiments, table 140 is formed to include an aperture having said diameter and extending therethrough, wherein that aperture is located at the approximate center of the table in the X/Y plane.

In the illustrated embodiment of FIG. 1, apparatus 100 further comprises a protective shelter comprising umbrella 160 and umbrella shaft 150. Further in the illustrated embodiment of FIG. 1, umbrella shaft 150 extends through assembly 130 and table 140. In the illustrated embodiment of FIG. 1, end 152 of shaft 150 contacts the ground. End 154 of shaft 150 is attached to umbrella assembly 160. In certain embodiments, shaft 150 in combination with umbrella assembly 160 is sold in commerce as a "patio umbrella."

Table 140 comprises a variety of shapes and dimensions. In certain embodiments, table 140 has a thickness of about 0.5 inch. In other embodiments, table 140 has a thickness of about 0.75 inch. In still other embodiments, table 140 has a thickness of about one inch. In yet other embodiments, table 140 has a thickness greater than one inch.

In certain embodiments, table 140 has a top surface area of about 1000 square inches. In other embodiments, table 140 has a top surface area of less than about 1000 square inches. In still other embodiments, table 140 has a top surface area of greater than about 1000 square inches.

In certain embodiments, table 140 has a square shape in the X/Y plane. In certain embodiments, table 140 has a rectangular shape in the X/Y plane. In other embodiments, table 140 has a round shape in the X/Y plane. In yet other embodiments, table 140 has a hexagonal shape in the X/Y plane. In still other embodiments, table 140 has an octagonal shape in the X/Y plane.

In certain embodiments, vertical assembly 130 is about 12 inches in length. As a general matter, horizontal assembly 120 is disposed at a height of about 17 inches above the ground. Using a vertical assembly having a length of 12 inches in combination with a one inch thick table positions the top of that table 140 about 30 inches above the ground. A typical dining table has a height above the ground of about thirty (30) inches.

A vertical assembly about 12 inches in length facilitates recreational use of Applicant's portable table apparatus. As those skilled in the art will appreciate, depending on the actual height of horizontal assembly 120 when attached to a vehicle, the length of vertical assembly 130 can be adjusted such that the top of table 140 is about 30 inches above the ground.

In certain embodiments, vertical assembly 130 is about 18 inches in length. As a general matter, horizontal assembly 120 is disposed at a height of about 17 inches above the ground. Using a vertical assembly having a length of 18 inches in combination with a one inch thick table positions the top of that table 140 about 36 inches above the ground. A typical counter/work bench height has a height above the ground of about thirty-six (36) inches. A vertical assembly about 18 inches in length facilitates commercial use of Applicant's portable table apparatus. As those skilled in the art will appreciate, depending on the actual height of horizontal assembly 120 when attached to a vehicle, the length of vertical assembly 130 can be adjusted such that the top of table 140 is about 36 inches above the ground.

As those skilled in the art will appreciate, the industry standard for bar counter height is 42 inches to 48 inches. Depending on the actual height of horizontal assembly 120 when attached to a vehicle, the length of vertical assembly 130 can be adjusted such that the top of table 140 is between about 42 inches and about 48 inches above the ground. In these bar counter height embodiments, conventional bar stools and/or folding director's chairs can be comfortably used in combination with Applicants' adjustable table apparatus Referring now to FIG. 2A, in certain embodiments assembly 120 comprises tubular member 210, member 220, and fixturing means 230. Tubular member 210 is formed to include an enclosure space 212 dimensioned such that all or a portion of member 220 can be slidingly disposed within space 212. The orientation of table 140 can be adjusted in a first plane orthogonal to the horizontal member, i.e. the Y/Z plane, by rotating member 220 and then fixturing member 220 to tubular member 210.

Figure 2A:
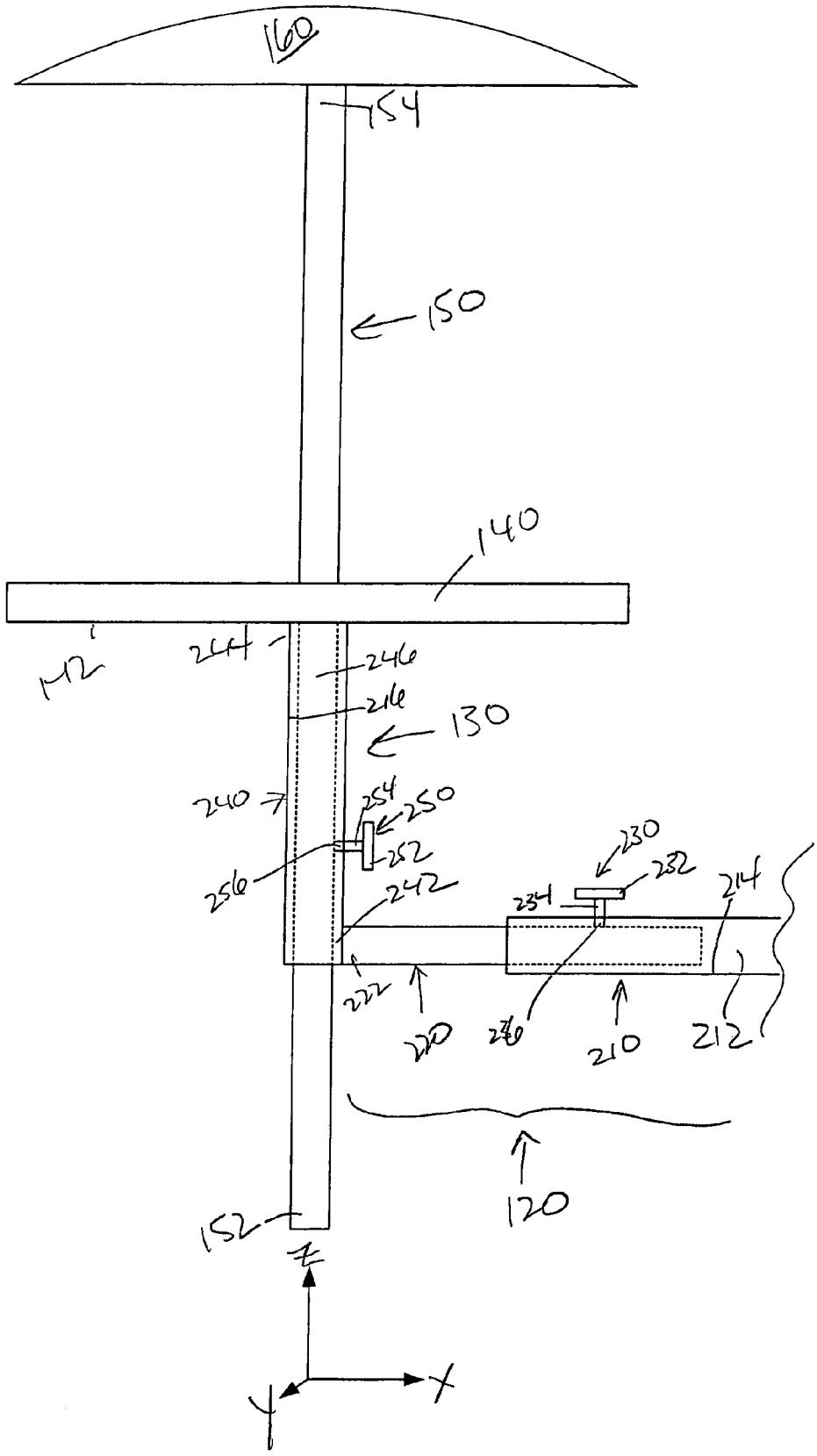
FIG. 2A is a side view showing one embodiment of Applicant's horizontal assembly.

In the illustrated embodiment of FIG. 2A, fixturing means 230 comprises a T-shaped apparatus comprising a handle 232 and a threaded shaft 234. In these embodiments, tubular member 210 is formed to include a threaded aperture into which threaded shaft 234 can be threadedly engaged.

In order to fixture member 220 within tubular member 210, handle 232 is rotated in a first direction such that shaft 234 is moved inwardly into space 212 until the distal end of shaft 234 contacts tubular member 220 and forces member 220 against the interior 214 of tubular member 210 thereby fixturing member 220 in place. In order to release tubular member 220 from tubular member 210, handle 232 is rotated in a second direction such that shaft 234 is moved outwardly such that the distal end of shaft 234 no longer forces member 220 against the interior 214 of tubular member 210 thereby releasing member 220.

In certain embodiments, the interior surface 214 of tubular member comprises a round cross-section. In these embodiments, member 220 also comprises a round cross-section. In other embodiments, the interior surface 214 of tubular member comprises a square cross-section. In these embodiments, member 220 also comprises a square cross-section. In yet other embodiments, the interior surface 214 of tubular member comprises a hexagonal cross-section. In these embodiments, member 220 also comprises a hexagonal cross-section. In still other embodiments, the interior surface 214 of tubular member comprises an octagonal cross-section. In these embodiments, member 220 also comprises an octagonal cross-section.

Figure 10:
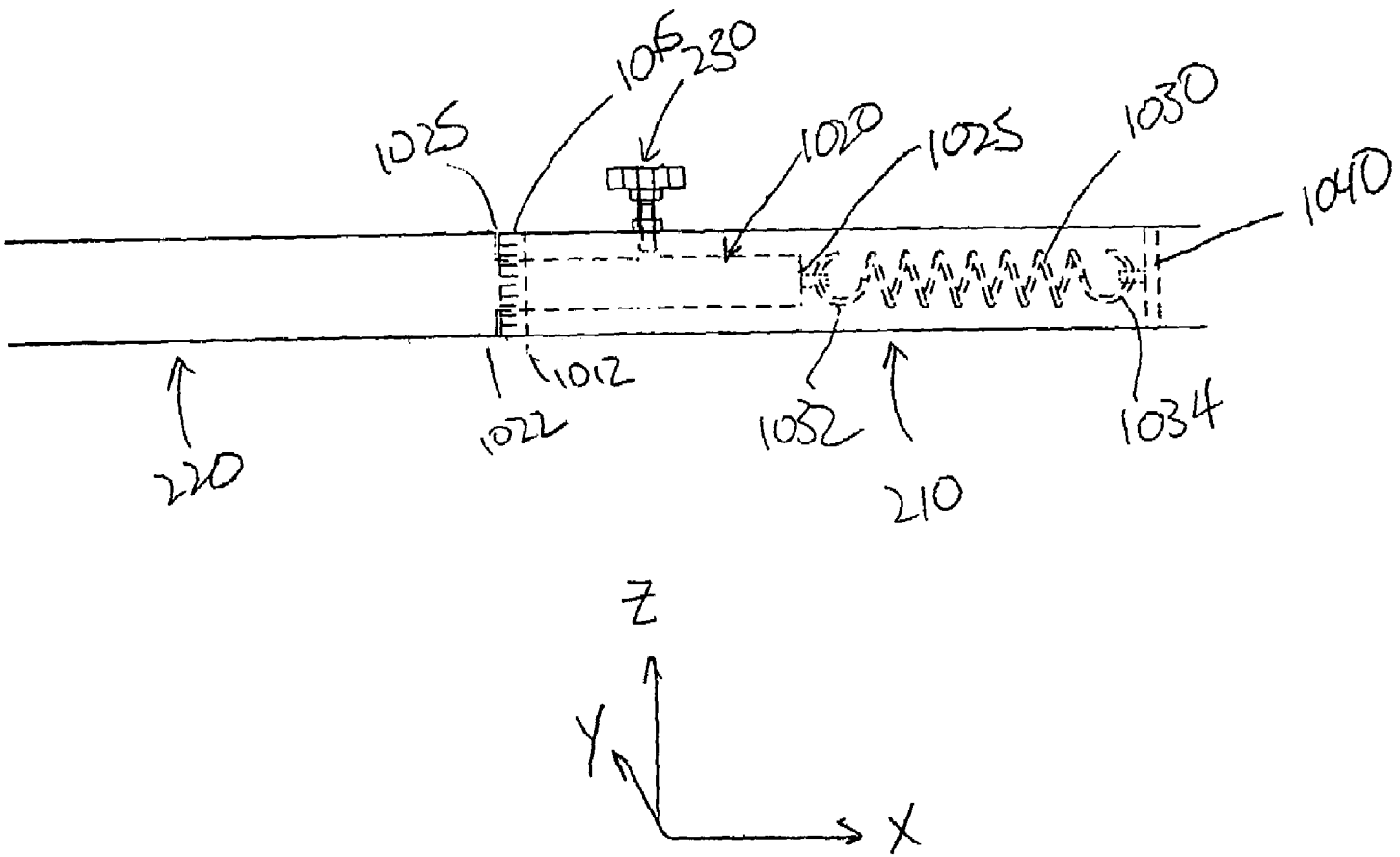
FIG. 10 is a side view showing an alternative embodiment for Applicant's horizontal assembly.

Referring now to FIG. 10, in certain embodiments member 220 comprises a first set of gear teeth 1025 disposed on end 1022. In these embodiments, member 210 comprises a second set of gear teeth 1015 disposed on end 1012. Member 1020 is attached to end 1022 of member 220 and extends outwardly therefrom. Member 1020 is dimensioned such that member 1020 can be inserted into tubular member 210. Gear teeth 1025 can be mated with gear teeth 1015 such that member 1020 cannot rotate within tubular member 210.

Spring 1030 is disposed within tubular member 210 and comprises first end 1032 and second end 1034. First end 1032 is attached to distal end 1025 of member 1020. Second end 1034 is attached to member 1040 which is disposed within tubular member 210. Spring 1030 is disposed within tubular member 210 such that spring 1030 pulls member 220 in the +X direction to keep gear teeth 1025 mated with gear teeth 1015.

In the embodiment of FIG. 10, the orientation of member 220 with respect to member 210 can be adjusted by manually pulling member 220 a sufficient distance in the −X direction to disengage gear teeth 1025 from gear teeth 1015. Member 220 can then to rotated in the Y/Z plane to a desired orientation. Thereafter, member 220 is released allowing spring 1030 to pull gear teeth 1025 into a mated relationship with gear teeth 1015 thereby locking member 220 into the desired orientation.

Referring again to FIG. 2A, assembly 130 comprises tubular member 240 and fixturing means 250. Tubular member 240 is formed to enclose space 246. In the illustrated embodiment of FIG. 2A, umbrella shaft 150 extends through table 140, and through tubular member 240, such that distal end 152 contacts the ground. Proximal end 154 of shaft 150 is attached to umbrella portion 160.

In the illustrated embodiment of FIG. 2A, fixturing means 250 comprises a T-shaped apparatus comprising a handle 252 and a threaded shaft 254. In these embodiments, tubular member 240 is formed to include a threaded aperture into which threaded shaft 254 can be threadedly engaged.

In order to releaseably fixture umbrella shaft 150 within tubular member 240, handle 252 is rotated in a first direction such that shaft 254 is moved inwardly into space 246 until the distal end of shaft 254 contacts shaft 150 and forces shaft 150 against the interior 246 of tubular member 240 thereby fixturing umbrella shaft 150 in place. In order to release umbrella shaft 150 from tubular member 240, handle 252 is rotated in a second direction such that shaft 254 is moved outwardly such that the distal end of shaft 254 no longer forces umbrella shaft 150 against the interior 246 of tubular member 240 thereby releasing umbrella shaft 150.

Figure 2B:
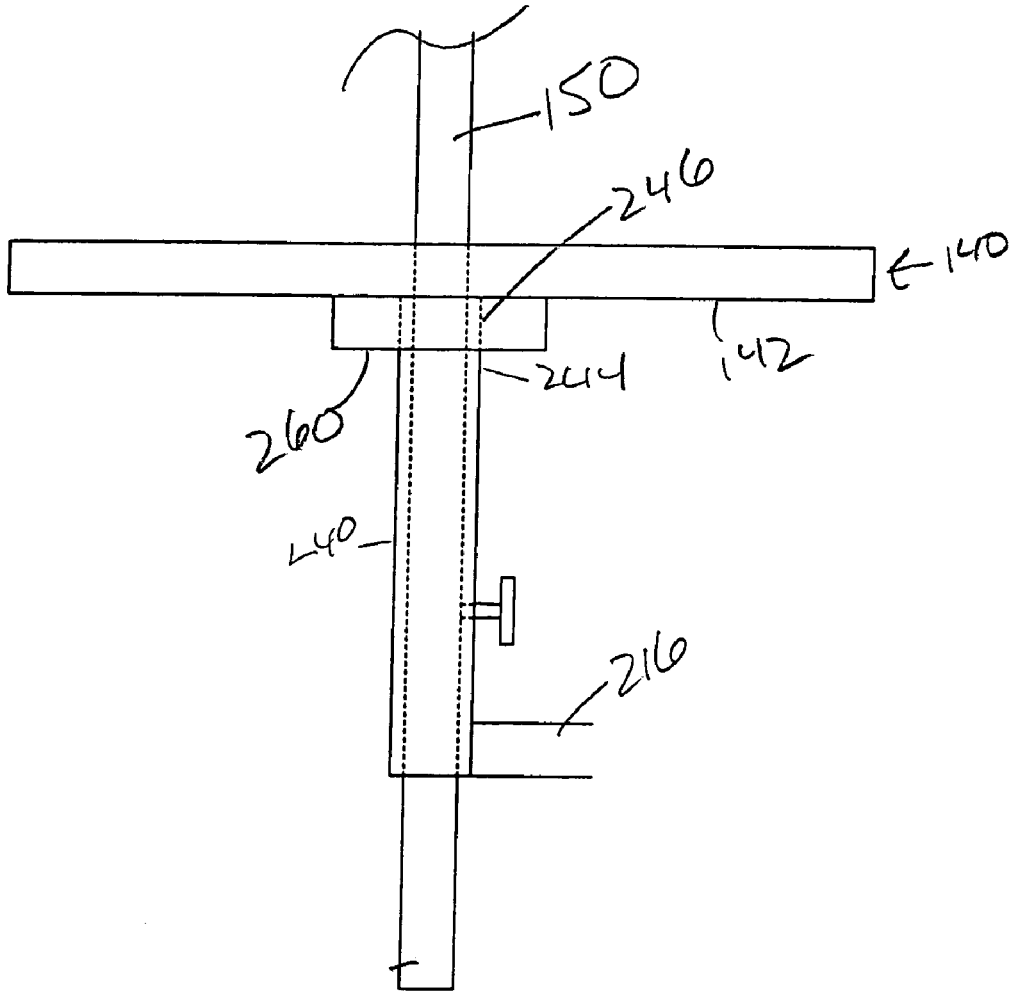
FIG. 2B shows one embodiment of the attachment of Applicant's table element to vertical assembly.

End 244 of tubular member 240 is attached to the bottom 142 of table 140. In certain embodiments, end 244 is releaseably attached to bottom 142. Referring now to FIG. 2B, in certain embodiments attachment plate 260 formed to include a threaded aperture is permanently affixed to bottom 142, wherein end 244 of tubular member 240 comprises threaded portion 246, wherein threaded portion 246 can engage the threaded aperture of attachment plate 260. In these embodiments, table 140 and tubular member 240 can be separated for transportation and/or storage.

Figure 3A:
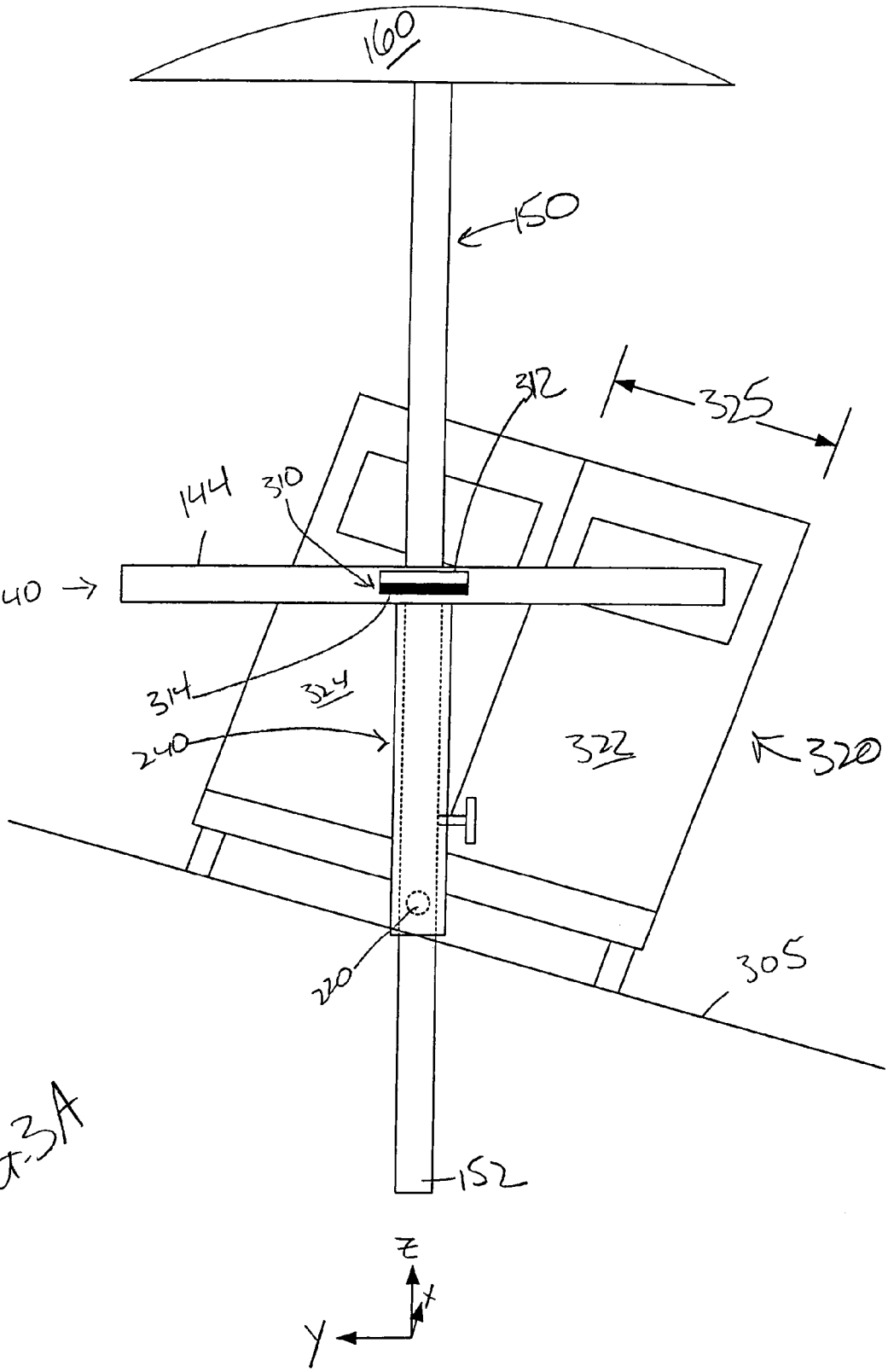
FIG. 3A shows a perspective view of the vehicle and apparatus of FIG. 1, wherein the vertical axis of Applicant's apparatus is offset from the vertical axis of the vehicle.

Referring now to FIGS. 2A and 3A, member 220 can be rotated in Y/Z plane to adjust the orientation of table 140 and umbrella 160 with respect to vehicle 320. In the illustrated embodiment of FIG. 3A, vehicle 320 is parked on an incline 305. Nevertheless, table 140 comprises a gravitationally level orientation, such that objects placed on top surface 144 of table 140 will not slide/roll off the table. In certain embodiments, table 140 further comprises leveling device 310 to assist in rotating member 220 within tubular member 210 such that table 140 comprises a gravitationally level orientation. As those skilled in the art will appreciate, leveling device 310 comprises an optically clear enclosure 312 which is partially filled with fluid 314, where the orientation of fluid 314 within enclosure 312 visually indicates the gravitational orientation of table 140.

Figure 3B:
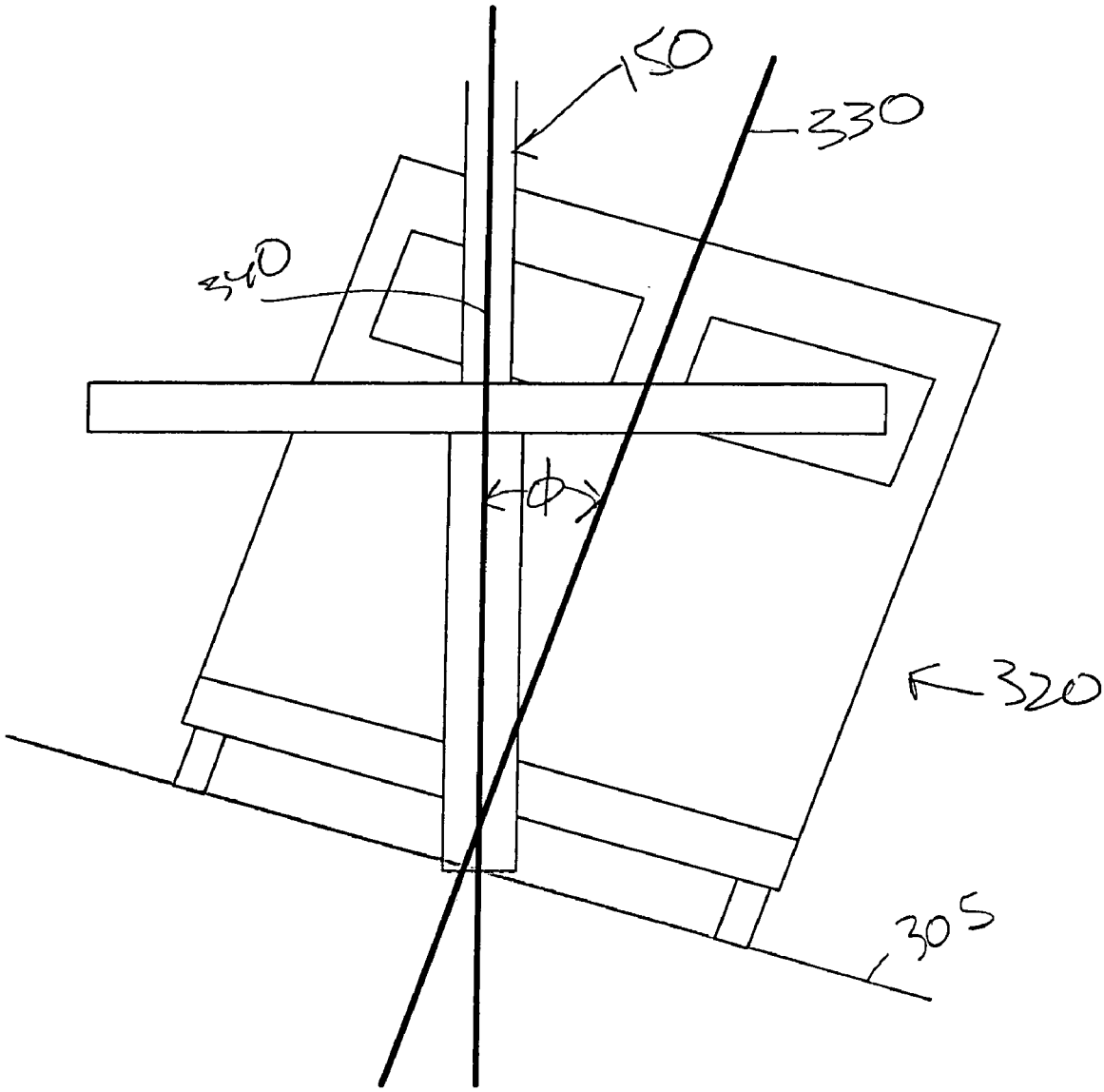
FIG. 3B graphically shows the vertical axis of Applicant's apparatus and the vertical axis of the vehicle.

Referring now to FIG. 3B, vehicle 320 has vertical axis 330, where that vertical axis 330 is perpendicular to ground surface 305. Umbrella shaft 150 has vertical axis 340. In the illustrated embodiments of FIGS. 2A and 2B, the umbrella shaft vertical axis 340 is offset from vehicle vertical axis 330 by angle Φ. In embodiments wherein interior surface 214 of tubular member 210 is round, and wherein member 220 comprises a round cross-section, angle Φ is continuously adjustable. In embodiments, wherein interior surface 214 of tubular member 210 comprises a hexagonal cross-section, and wherein member 220 comprises a hexagonal cross-section, angle Φ is adjustable in 60 degree increments. As a general matter, where interior surface 214 of tubular member 210 is formed to comprise (N) sides, i.e. interior surface 214 comprises an (N)thagonal cross-section, and where member 220 also comprises that same (N)thagonal cross-section, then angle Φ is adjustable in 360/(N) degree increments.

Figure 4A:
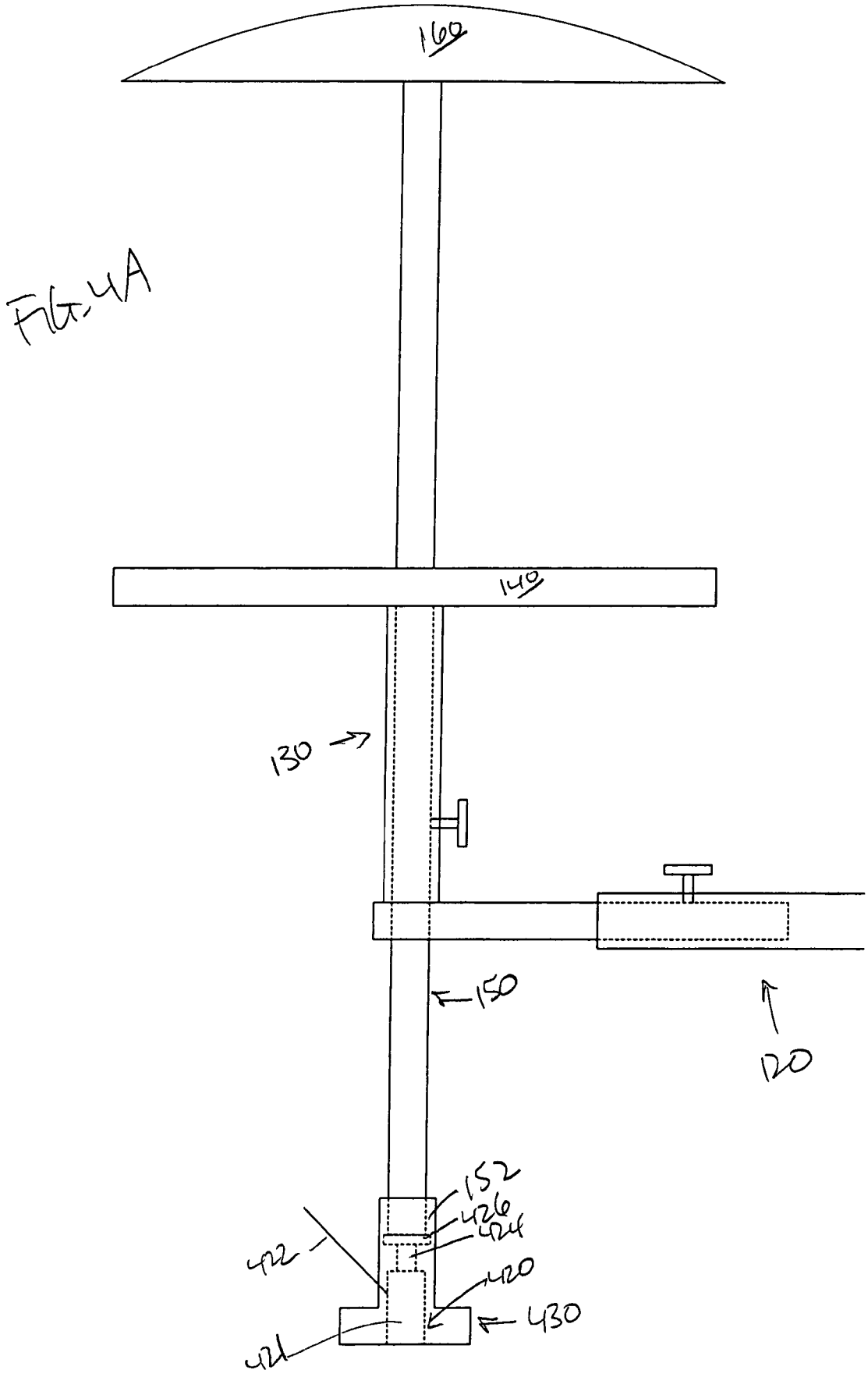
FIG. 4A is a side view of a one embodiment of Applicant's lifting apparatus disposed in the apparatus of claim 1.

In certain embodiments, Applicant's apparatus includes a lifting mechanism to adjust the height of umbrella portion 160. For example, the illustrated embodiment of FIG. 4A includes base assembly 430. Assembly 430 comprises hydraulic lifting mechanism 420. Lifting mechanism 420 comprises handle 422, hydraulic actuator 421, and moveable shaft 424. In certain embodiments, platen 426 is disposed on the distal end of shaft 424.

Moving handle upwardly and downwardly raises shaft 424 upwardly, thereby increasing the height above the ground of umbrella 160. After reversing the operational mechanism of lifting mechanism 420, moving handle upwardly and downwardly lowers shaft 424 upwardly, thereby decreasing the height above the ground of umbrella 160.

Figure 4B:
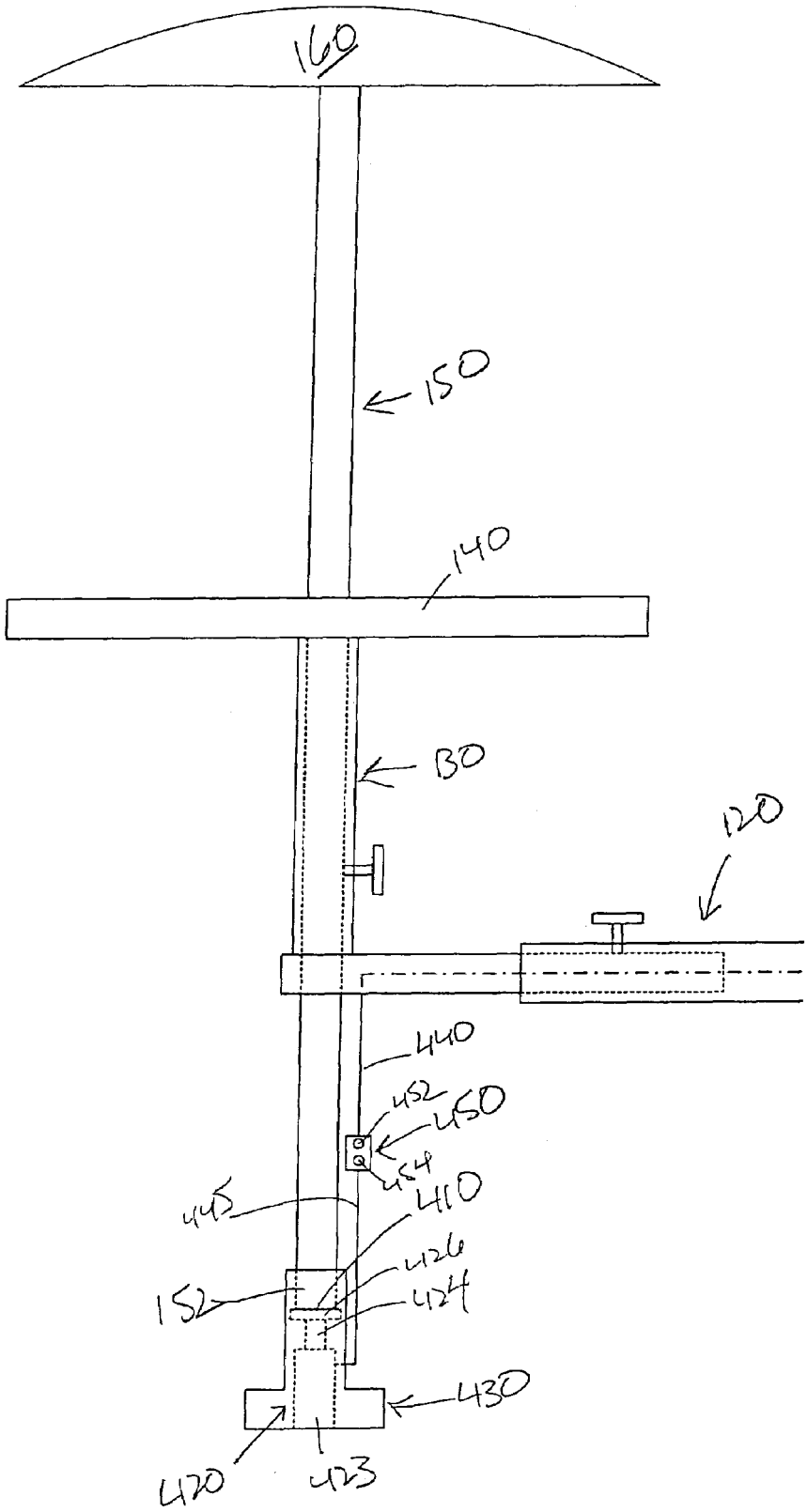
FIG. 4B a side view of a second embodiment of Applicant's lifting apparatus disposed in the apparatus of claim 2.

In certain embodiments, Applicant's apparatus further comprises an electrical lifting mechanism. Referring now to FIG. 4B, power cable 440 interconnects the 12 Volt electrical system disposed in a vehicle, such as for example vehicle 110 or vehicle 320, and switch 450. Power cable 445 interconnects switch 450 and motor 423. Switch 450 comprises first actuator 452 and second actuator 454. In the illustrated actuator 452 comprises a first push-button and actuator 454 comprises a second push-button. Depressing button 452 causes motor 423 to move shaft 424 in a first direction. In certain embodiments, that first direction is upwardly, i.e. in the +Z direction. Depressing button 454 causes motor 423 to move shaft 424 in a second direction. In certain embodiments, that second direction is downwardly, i.e. in the −Z direction.

End 152 of umbrella shaft 150 rests on top of shaft 424, or optionally on top of platen 426. Depressing button 452 causes motor 423 to move shaft 424 upwardly thereby elevating umbrella portion 160. Depressing button 454 causes motor 423 to move shaft 424 downwardly thereby lowering umbrella portion 160.

Figure 5:
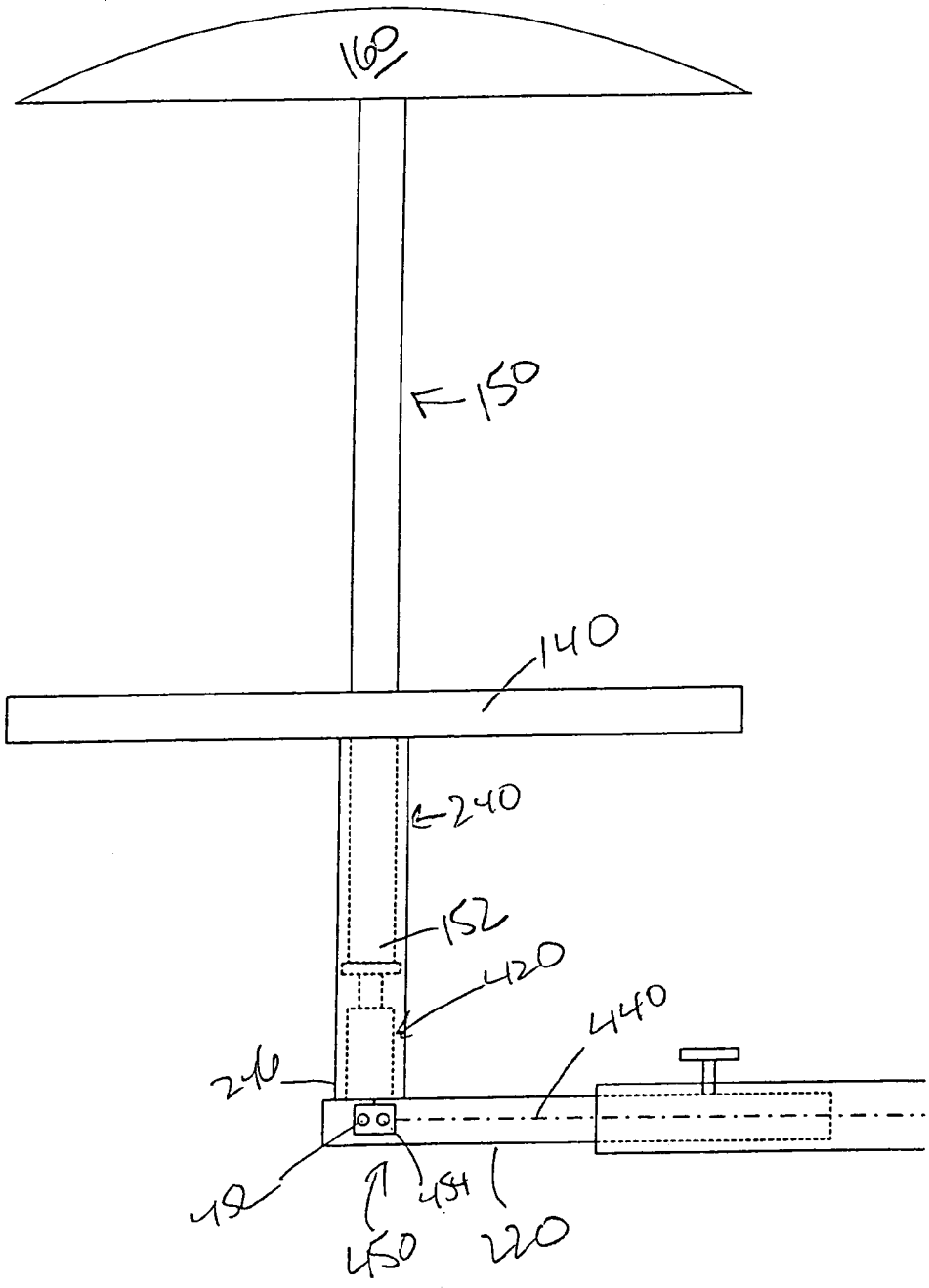
FIG. 5 is a side view of a second embodiment of Applicant's apparatus of claim 1, where that second embodiment includes the lifting apparatus of FIG. 4B.

In the illustrated embodiment of FIG. 5, lifting assembly 420 is disposed within end 246 of tubular member 240, and switch 450 is disposed on member 220. Depressing button 452 causes motor 422 to move shaft 424 upwardly thereby elevating umbrella portion 160. Depressing button 454 causes motor 422 to move shaft 424 downwardly thereby lowering umbrella portion 160.

In certain embodiments, Applicant's apparatus further comprises a plurality of lights disposed on umbrella 160, where those lights receive power from power cable 440. In yet other embodiments, Applicant's apparatus further comprises one or more power receptacles disposed on horizontal member 120, and/or table 140, wherein those one or more power receptacles receive power from power cable 440.

Figure 11:
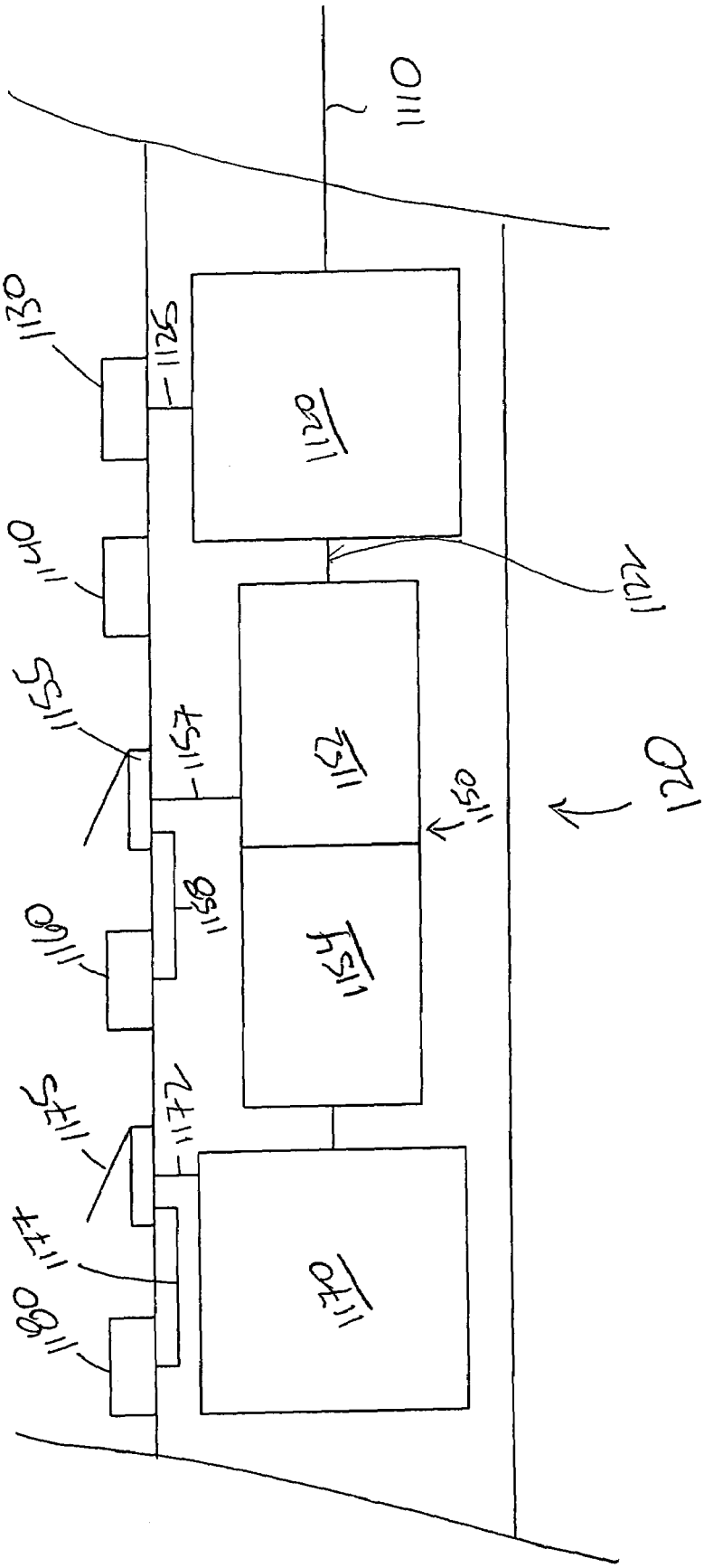
FIG. 11 is a block diagram showing certain electrical components disposed within and on Applicants' horizontal assembly.

Referring now to FIG. 11, in certain embodiments a plurality of rechargeable batteries 1150 are disposed within horizontal assembly 120. FIG. 11 shows two rechargeable batteries 1152 and 1154. In other embodiments, Applicant's apparatus comprises one rechargeable battery disposed within horizontal assembly 120. In still other embodiments, Applicant's apparatus comprises more than two rechargeable batteries disposed within horizontal assembly 120.

Plurality of rechargeable batteries 1150 receive charging power from charging unit 1120 via power conduit 1122. Charging unit 1120 is capable of receiving 115 volt, 60 hertz, AC input power and/or 12 volt DC input power. Charging unit 1120 receives DC input power from DC power conduit 1110 which interconnects with the vehicular power system disposed in the attached vehicle.

Charging unit 1120 receives AC input power from receptacle 1130 which is disposed on the exterior of horizontal assembly 120. As those skilled in the art will appreciate, receptacle 1130 can be interconnected using an extension cord with a source of nominal 115 volt/60 hertz utility power. Moreover, plurality of batteries 1150 can be recharged using charging unit 1120, receptacle 1130, and utility power, when Applicant's apparatus is disposed adjacent a source of utility power.

Indicator 1140 is disposed on the exterior of horizontal assembly 120. Indicator 1140 emits light in proportion to the amount of input power being consumed by charging unit 1120. In certain embodiments, indicator 1140 comprises one or more light emitting diodes and/or gauges.

Plurality of batteries 1150 are electrically interconnected to switch 1155 via DC power conduit 1157. Switch 1155 is electrically interconnected with DC output power receptacle 1160 via DC power conduit 1158. When switch 1155 is closed, plurality of batteries 1150 provide DC power to DC output power receptacle 1160.

Plurality of batteries 1150 are electrically interconnected to power inverter 1170 which is disposed within horizontal assembly 120. Inverter 1170 receives DC input power from batteries 1150 and provides 115 volt, 60 hertz, AC power to switch 1175 via AC power conduit 1172. Switch 1175 is electrically interconnected with AC switch 1175. Switch 1175 is electrically interconnected with AC output receptacle 1180 via power conduit 1177. When switch 1175 is closed, inverter 1170 draws DC power from plurality of batteries 1150, converts that DC power to AC power, and provides that AC power to AC output receptacle 1180 via switch 1175 and power conduits 1172 and 1177.

Figure 8:
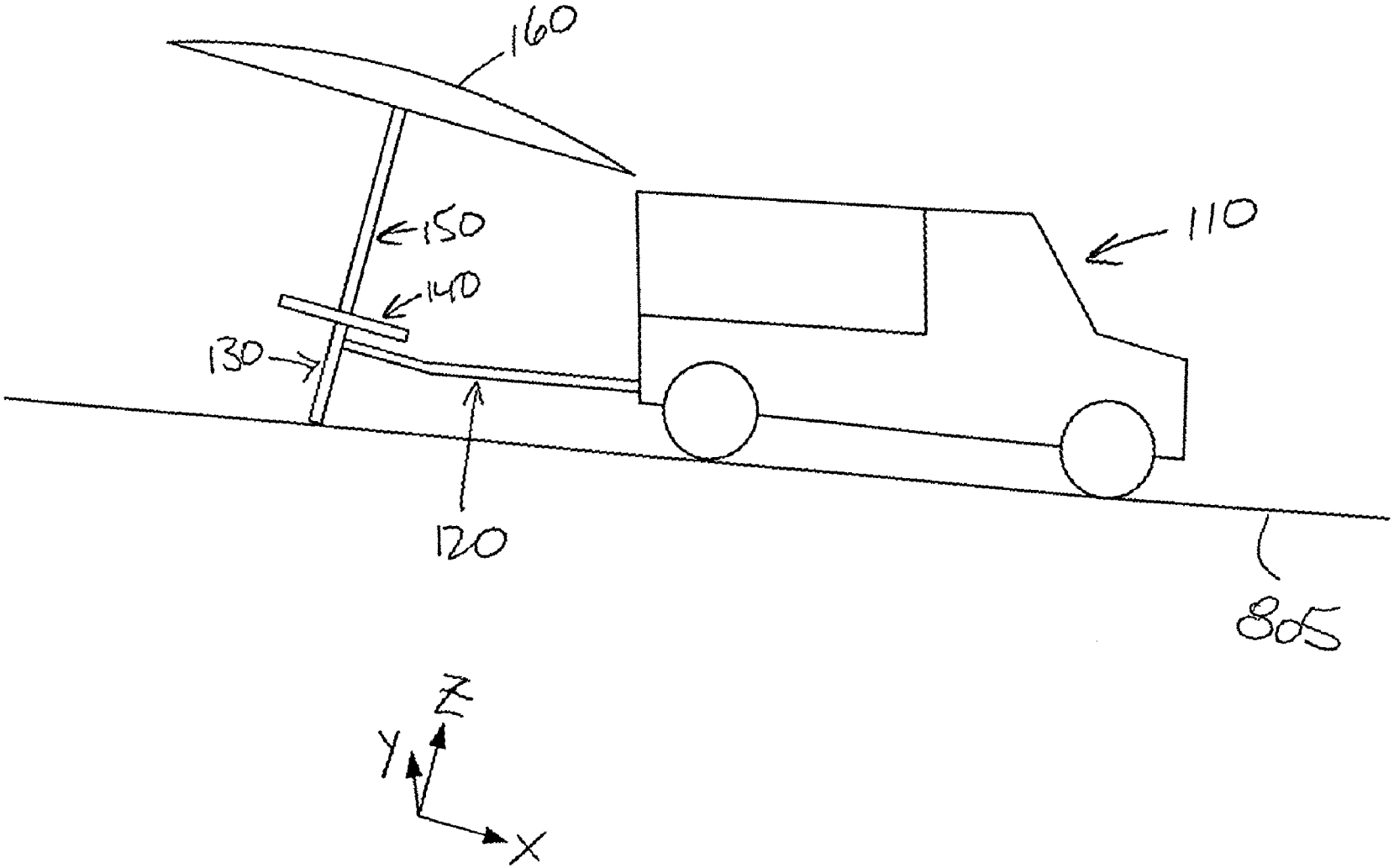
FIG. 8 shows a side view of another embodiment of Applicant's apparatus which comprises an adjustment means to keep the table portion of Applicant's apparatus level when the attached vehicle is disposed on an incline.

Referring now to FIG. 8, in certain embodiments Applicant's apparatus permits the adjustment of table 140 and umbrella 160 in a second plane, i.e. the X/Z plane, wherein the second plane is orthogonal to the first plane. FIG. 8 shows vehicle disposed on an incline 805. If horizontal assembly 120 could not be adjusted in the X/Z plane, then table 140 would not be level when vehicle 110 is parked on incline 805.

Figure 9:
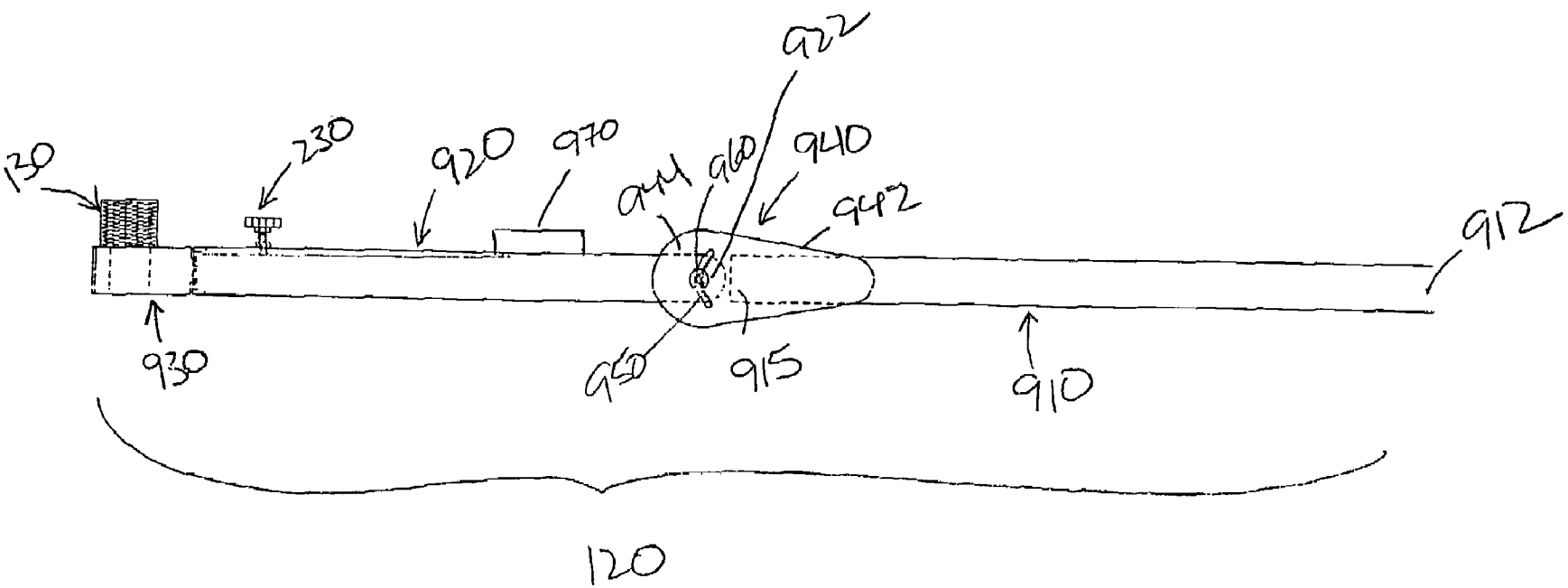
FIG. 9 shows a side view of a portion of the apparatus of FIG. 8.

In the embodiment of Applicant's apparatus shown in FIGS. 8 and 9, horizontal assembly 120 comprises member 910, member 920, and member 930. Member 920 comprises a tubular member. Member 930 is dimensioned to be slidingly insertable within tubular member 920, such that the length of horizontal assembly 120 can be adjusted by increasing or decreasing the portion of member 930 disposed within member 920. The orientation of table 140 and umbrella 160 can be adjusted in the Y/Z plane by rotating member 920 to the desired orientation and then releaseably fixturing member 930 to member 920 using fixturing means 230 in the manner described above.

The orientation of table 140 and umbrella 160 can also be adjusted in the second X/Z plane. Leveling device 970 is disposed on member 920 to visually assist the adjustment of table 140 and umbrella 160 in the X/Z plane. Leveling device 970 comprises an optically clear enclosure which is partially filled with fluid, where the orientation of that fluid within the enclosure visually indicates the gravitational orientation of table 140.

Member 920 is adjustably attached to member 910 using plate 940. Plate 940 comprises proximal portion 942 and distal portion 944. Proximal portion 942 of plate 940 is attached to distal end 915 of member 910. Proximal end 912 of member 910 can be releaseably attached to a trailer hitch as described above. Plate 940 can be attached to end 915 using conventional attachment methods including, for example, welding, integral forming, mechanical attachment using nets and bolts, and the like. Distal portion 944 of plate 940 extends outwardly from end 915 of member 910.

Curved gear lock 950, comprising a plurality of gear teeth, is attached to the exterior surface of distal portion 944 of plate 940. Distal portion 944 of plate 940 is formed to include a threaded aperture extending therethrough adjacent to gear lock 950. End 922 of member 920 is formed to include an aperture therethrough. In certain embodiments, end 922 of member 920 is formed to include a threaded aperture therethrough After adjusting the orientation table 140 and umbrella 160 in the X/Z plane, i.e. adjusting the orientation of member 920 with respect to member 910, threaded bolt 960 is inserted through the aperture formed in end 922 of member 920. In certain embodiments, threaded bolt 960 is threadedly engaged with, and through, the aperture formed in end 922 of member 920.

Threaded bolt 960 extends through the aperture formed in distal portion 944 of plate 940 such that threaded bolt 960 threadedly engages gear lock 950, thereby fixturing member 920 to member 910. In certain embodiments, threaded bolt 960 is threadedly engaged with, and through, the aperture in distal portion 944 of plate 940.

Figure 6:
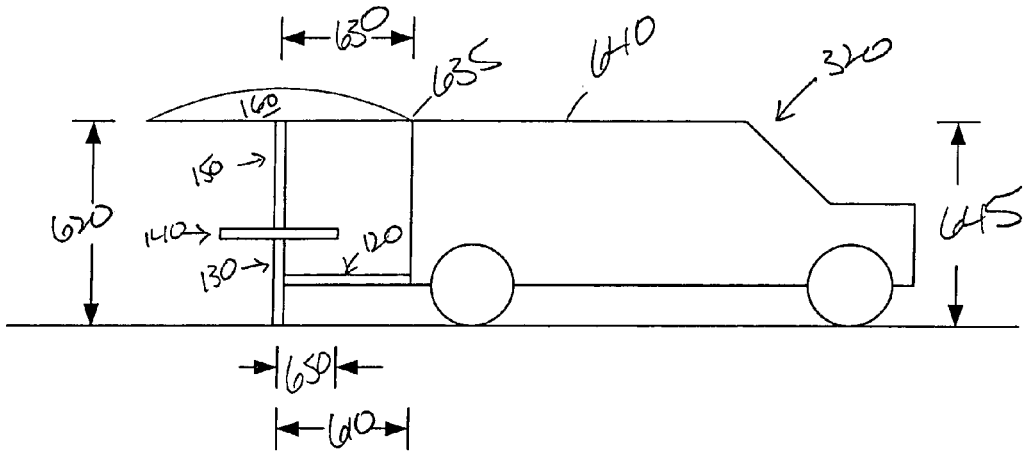
FIG. 6 is a side view showing certain dimensions of Applicant's apparatus with respect to a first attached vehicle.

Referring now to FIG. 6, Applicant's apparatus allows the distance 610 between vehicle 320 and vertical assembly 130 to be adjusted. In the illustrated embodiment of FIG. 6, table 140 comprises a radius 650. By radius of table 140, Applicant means the greatest straight-line distance from shaft 150 to an edge of table 140. Referring again to FIG. 3A, vehicle 320 comprises rear door 322 and rear door 324, each of which has a width 325. Distance 610 can be adjusted such that doors 322 and 324 can be opened and closed while Applicant's apparatus 100 remains interconnected to vehicle 320. More specifically, the length of assembly 120 can be adjusted such that distance 610 minus table radius 650 is greater than rear door width 325.

Applicant's apparatus allows distance 620, i.e. the height of umbrella 160, to be adjusted. In certain embodiments, distances 610 and 620 are adjusted such that distal portion 635 of umbrella portion 160 contacts roof 640 of vehicle 320. Radius 630 of umbrella portion 160 can be dimensioned such that doors 322 and 324 can be opened and closed while umbrella 160 remains attached to vehicle roof 640. In certain embodiments, radius 630 is about 3 feet. In certain embodiments, radius 630 is about 4 feet. In certain embodiments, radius 630 is about 5 feet. In certain embodiments, radius 630 is about 6 feet.

In certain embodiments, distal portion 635 of umbrella 160 is releaseably attached to roof 640. In certain embodiments, such a releasable attachment comprises one or more hook and loop fasteners. In other embodiments, such as releasable attachment comprises one or more two-piece mechanical snap assemblies. In the illustrated embodiment of FIG. 6, the interior of vehicle 320 is protected from inclement weather, such as for example rain, snow, and the like, even if doors 322 and 324 are opened.

Figure 7:
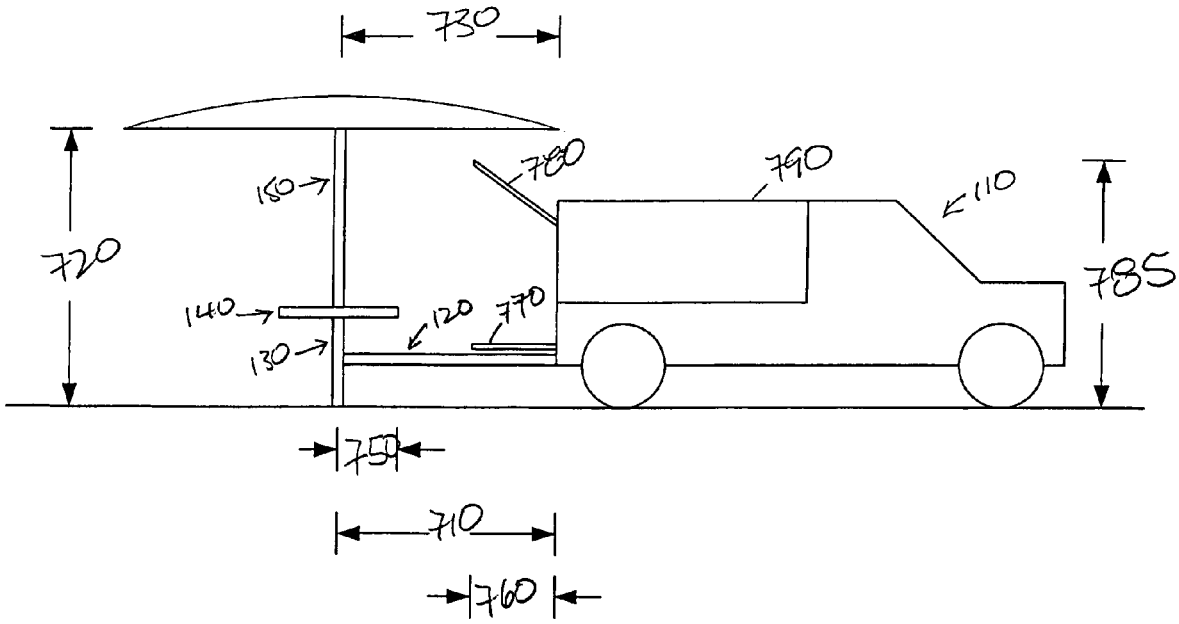
FIG. 7 is a side view showing certain dimensions of Applicant's apparatus with respect to a second attached vehicle.

Referring now to FIG. 7, Applicant's apparatus allows the distance 710 between vehicle 110 and vertical assembly 130 to be adjusted. In the illustrated embodiment of FIG. 7, vehicle 110 comprises tailgate 770 and pivoting hatch-back 780. As those skilled in the art will appreciate, certain vehicles comprise a pivoting hatch-back that extends from the roof to the floor of the vehicle. References herein to "pivoting hatch-back" include the embodiment illustrated in FIG. 7 and also to embodiments wherein the pivoting hatch-back extends from the roof to the floor.

When opened, tailgate 770 extends a horizontal distance 760 backwardly from vehicle 110. When opened, hatch-back 780 extends a horizontal distance 760 backwardly from vehicle 110, and extends a vertical distance 785 above the ground. The length of assembly 120 can be adjusted such tailgate 770 and/or hatch-back 780 can be opened and closed while Applicant's apparatus 100 remains interconnected to vehicle 110. More specifically, the length of assembly 120 can be adjusted such that distance 710 minus table radius 750 is greater than distance 760.

Applicant's apparatus allows distance 720, i.e. the height of umbrella 160, to be adjusted. In certain embodiments, distances 710 and 720 are adjusted such that distance 710 minus table radius 750 is greater than distance 760, and such that distance 720 is greater than distance 785. In the illustrated embodiment of FIG. 7, distance 720 is adjusted such that distal end 735 of umbrella 160 is positioned over a portion of roof 790.

Radius 730 of umbrella portion 160 can be dimensioned such that tailgate 770 and/or hatch-back 780 can be opened and closed while Applicant's apparatus 100 remains interconnected to vehicle 110. In certain embodiments, radius 730 is about 3 feet. In certain embodiments, radius 730 is about 4 feet. In certain embodiments, radius 730 is about 5 feet. In certain embodiments, radius 730 is about 6 feet.

In the illustrated embodiment of FIG. 7, distance 710 minus table radius 750 is greater than distance 760, distance 720 is greater than distance 785, and radius 730 is greater than distance 710. In the illustrated embodiment of FIG. 7, the interior of vehicle 110 is protected from inclement weather, such as for example rain, snow, and the like, even if tailgate 770 and/or hatch-back 780 are opened.

Figure 14:
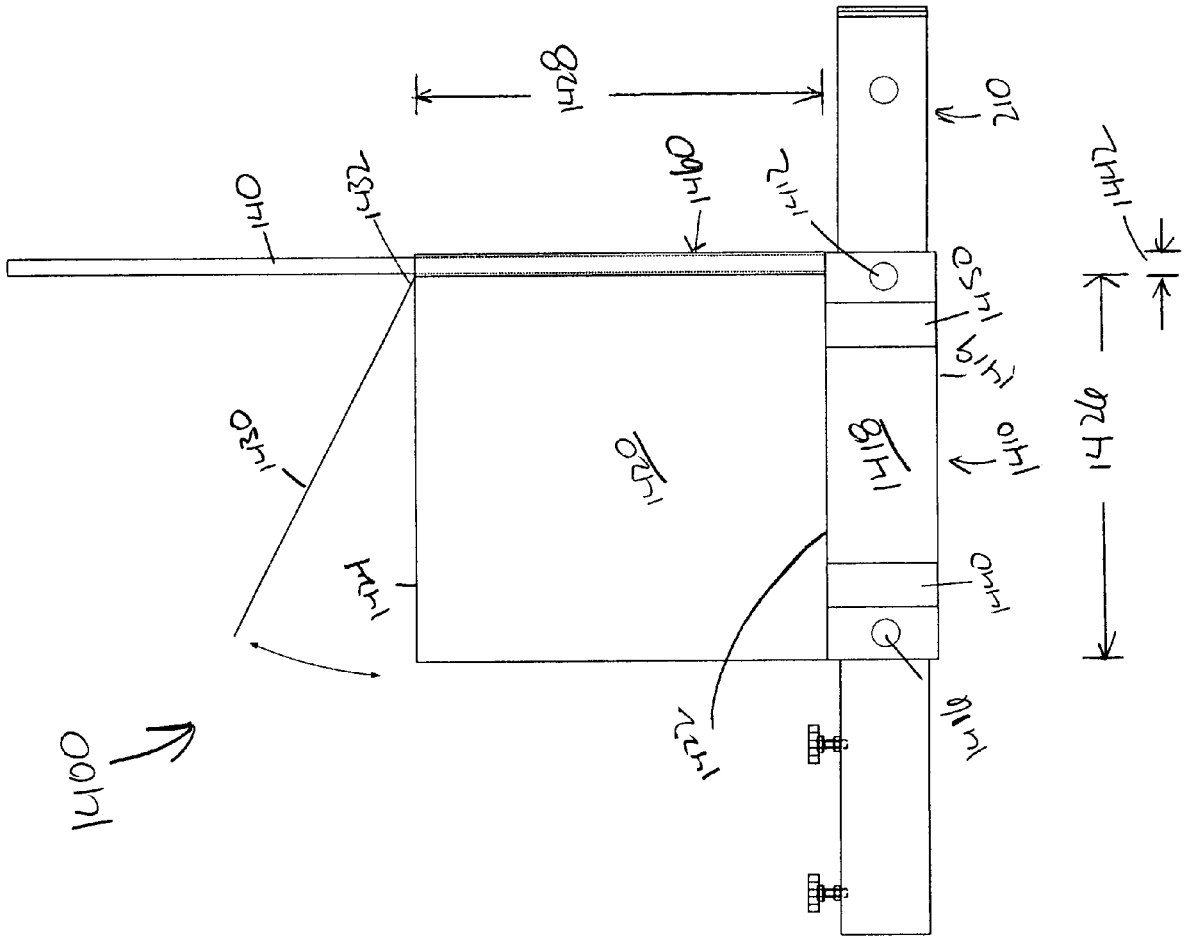
FIG. 14 shows a side view of Applicant's storage container.

In certain embodiments Applicant's portable table assembly further comprises one or more storage containers in combination with the elements describer hereinabove. FIG. 14 shows a side view of storage container assembly 1400. Assembly 1400 comprises first storage container 1420 disposed on tubular member 1410. Storage container 1420 is formed from one or more rigid materials selected from the group consisting of wood, metal, plastic, and combinations thereof. Storage container 1420 comprises one or more walls and bottom 1422. As those skilled in the art will appreciate, in embodiments wherein storage container 1420 comprises one wall that container comprises a cylinder extending upwardly from bottom 1422. In embodiments wherein storage container 1420 comprises four walls that container comprises a parallelepiped extending upwardly from bottom 1422.

Storage container 1420 comprises length 1426, height 1428, and width 1620 (FIG. 16). In certain embodiments, length 1426 is between about 12 inches and about 30 inches. In certain embodiments, length 1426 is 20 inches. In certain embodiments, height 1428 is between about 3 inches and about 24 inches. In certain embodiments, height 1428 is 12 inches.

In the illustrated embodiment of FIG. 14, member 1430 is pivotally attached to top portion 1424 of storage container 1420 along edge 1432. In certain embodiments, member 1430 is hingedly attached to storage container 1420.

In the illustrated embodiment of FIG. 14, storage container assembly 1400 further comprises storage container 1460. Storage container 1460 comprises length 1442, height 1428, and width 1620. In certain embodiments, length 1442 is between about 1 inches and about 6 inches. In certain embodiments, length 1442 is 2 inches.

In the illustrated embodiment of FIG. 14, table 140 is removeably disposed in storage container 1460. As described herein, in various embodiments table 140 comprises a variety of shapes, such as without limitation round, square, rectangular, hexagonal, and the like. Regardless of shape, table 140 comprises a table diameter and a table thickness, wherein the table diameter comprises the longest dimension across the surface of table 140 which passes through the table's center. In the illustrated embodiment of FIG. 14, length 1442 is greater than the table thickness and width 1620 is greater than the table diameter.

Figure 15A:
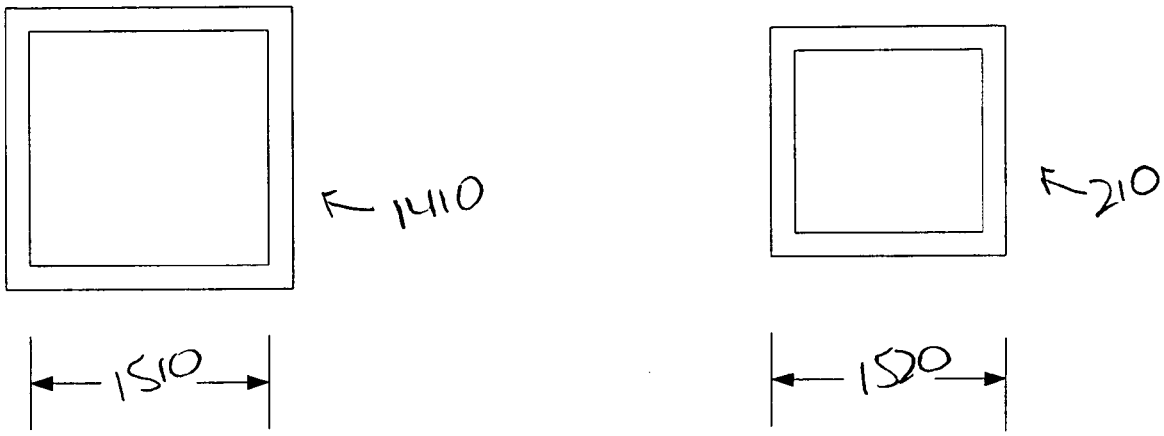
FIG. 15A shows cross-sectional views of Applicants' square tubular horizontal member and a square slideable tubular member element of Applicant's storage container.

Referring to FIG. 15A, in certain embodiments tubular member 210 comprises a square cross-section having an outer dimension 1520. In these embodiments, tubular member 1410 comprises a square cross-section having inner dimension 1510, wherein inner dimension 1510 is greater than outer dimension 1520 such that tubular member 1410 can be slidingly disposed over tubular member 210.

Figure 15B:
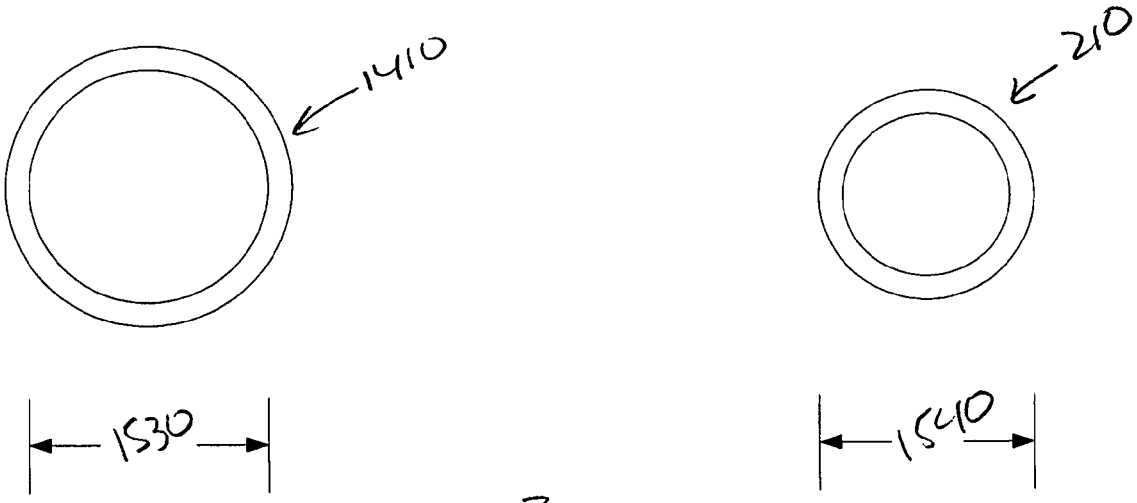
FIG. 15B shows cross-sectional views of Applicant's round tubular horizontal member and a round slideable tubular member.
Figure 15C:
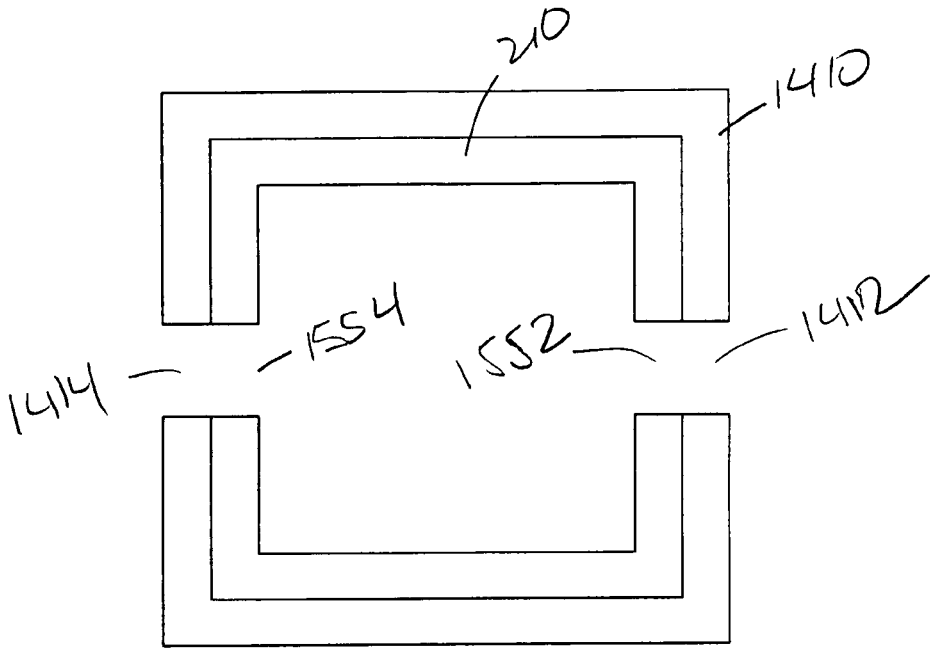
FIG. 15C shows the square horizontal tubular member of FIG. 15A disposed within the square slideable tubular member of FIG. 15A.
Figure 15D:
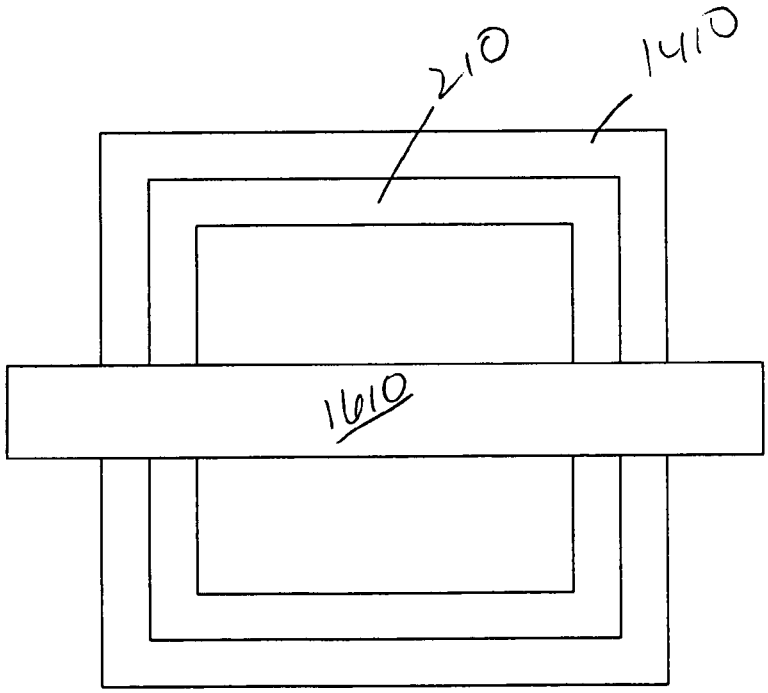
FIG. 15D shows the configuration of FIG. 15C in combination with a locking pin securing the square horizontal tubular member to the square slideable tubular member.
Figure 19:
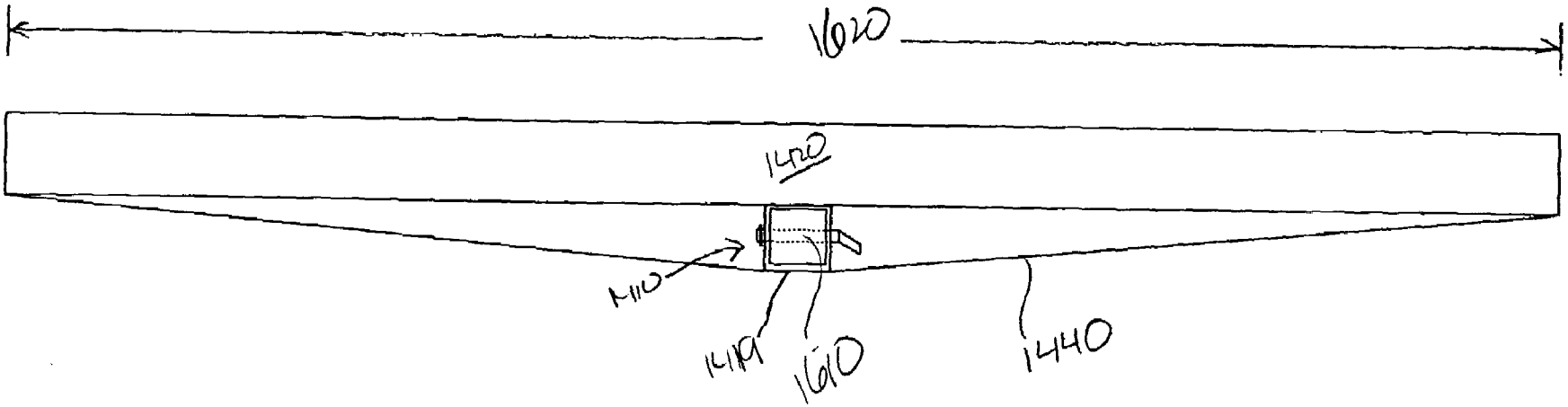
FIG. 19A shows a cross-sectional view of Applicant's square tubular horizontal member disposed within the square slideable tubular member portion of Applicant's bicycle rack.
FIG. 19B shows the configuration of FIG. 19A in combination with a locking pin securing the square horizontal tubular member to the square slideable tubular member.

Referring to FIG. 15B, in certain embodiments tubular member 210 comprises a circular cross-section having an outer diameter 1540. In these embodiments, tubular member 1410 comprises a circular cross-section comprising an interior diameter 1530, wherein diameter 1530 is greater than diameter 1540 such that tubular member 1410 can be slidingly disposed over tubular member 210.

Referring now to FIGS. 14, 15C, 15D, and 16, tubular member 1410 is formed to include aperture 1412 extending therethrough. Tubular member 1410 is formed to further include an opposing aperture 1414 extending therethrough. Tubular member 210 is formed to comprise opposing apertures 1552 and 1554 extending therethrough. In the illustrated embodiment of FIG. 16, tubular member 1410 is slidingly positioned such that apertures 1412 and 1552 are aligned, and such that apertures 1414 and 1554 are aligned, such that securing member 1610 (FIGS. 15D, 16) can be removeably extended through apertures 1412 and 1414 in tubular member 1410 and through corresponding apertures 1552 and 1554 in tubular member 210 to releaseably secure tubular member 1410 to tubular member 210.

In the illustrated embodiment of FIG. 14, tubular member 1410 is formed to further comprise aperture 1416. In these embodiments, tubular member 1410 is formed to comprise an opposing aperture to aperture 1416, and tubular member 210 is formed to comprise a corresponding set of apertures such that a second securing member can be removeably extended through the second set of apertures formed in tubular member 1410 and through the second set of aperture formed in tubular member 210.

Referring now to FIGS. 14 and 16, one end of brace 1440 is attached to side 1418 of tubular member 1410 and the other end of brace 1440 is attached to the opposing side of tubular member 1410 such that the middle portion of brace 1440 is attached to the bottom portion 1416 of tubular member 1410. Similarly, one end of brace 1450 is attached to side 1418 of tubular member 1410 and the other end of brace 1450 is attached to the opposing side of tubular member 1410 such that the middle portion of brace 1450 is attached to the bottom portion 1416 of tubular member 1410.

Figure 17:
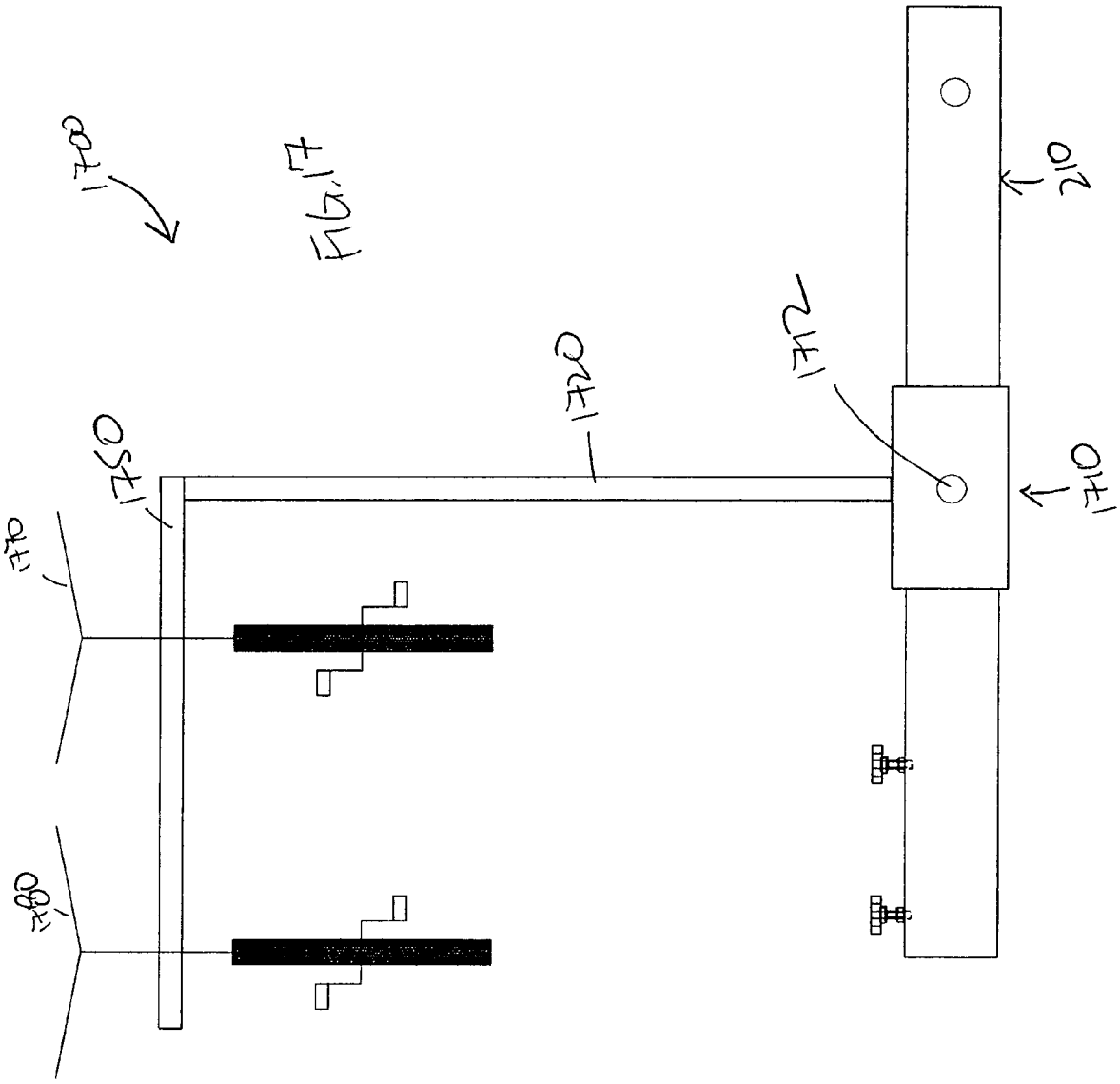
FIG. 17 shows a side view of a first embodiment of Applicant's bicycle rack.
Figure 18:
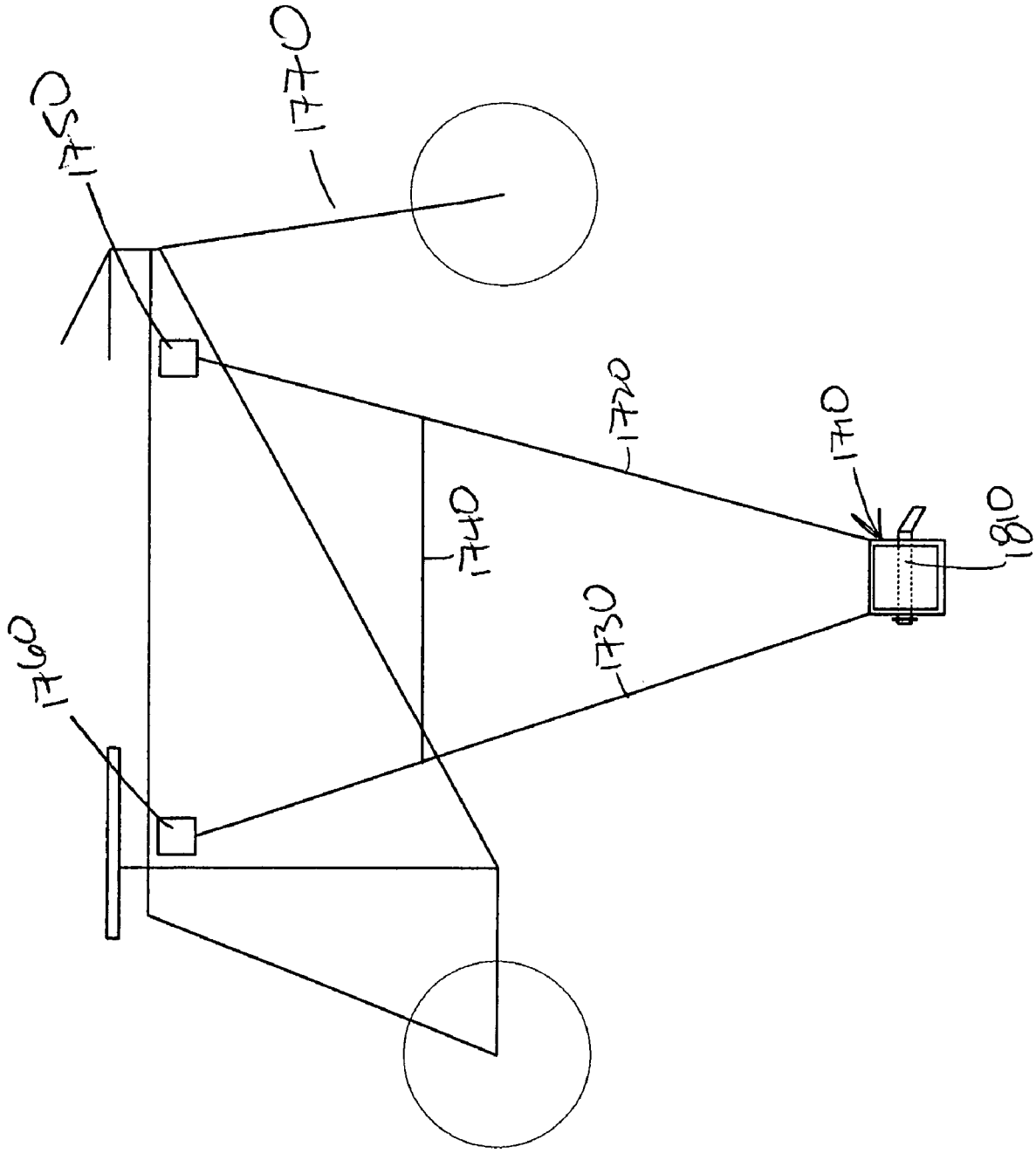
FIG. 18 shows a front view of the bicycle rack of FIG. 17.

In certain embodiments Applicant's portable table assembly further comprises a bicycle rack in combination with the elements described herein above. Referring now to FIGS. 17 and 18, FIG. 17 shows a side view of a first embodiment of Applicant's bicycle rack assembly. Assembly 1700 comprises member 1720, wherein a first end of member 1720 is attached to tubular member 1710 and a second end of member 1720 extends upwardly from tubular member 1710. In certain embodiments, member 1720 comprises a length between about 24 inches and about 48 inches. In certain embodiments, member 1720 comprises a length of 36 inches.

Assembly 1700 further comprises member 1730, wherein a first end of member 1730 is attached to tubular member 1710 and a second end of member 1730 extends upwardly from tubular member 1710. In certain embodiments, member 1730 comprises a length between about 24 inches and about 48 inches. In certain embodiments, member 1730 comprises a length of 36 inches.

In the illustrated embodiment of FIG. 18, assembly 1700 further comprises cross-member 1740 which interconnects members 1720 and 1730. In certain embodiments, member 1740 comprises a length between about 6 inches and about 12 inches. In certain embodiments, member 1740 comprises a length of 8 inches.

Bicycle assembly 1700 further comprises horizontal members 1750 and 1760. Bicycle 1770 is supported by members 1750 and 1760. A first end of horizontal member 1750 is attached to the second end of member 1720, and the second end of horizontal member 1750 extends outwardly from member 1720. In certain embodiments, member 1750 comprises a length between about 12 inches and about 28 inches. In certain embodiments, member 1750 comprises a length of 24 inches.

A first end of horizontal member 1760 is attached to the second end of member 1730, and the second end of horizontal ember 1760 extends outwardly from member 1730. In certain embodiments, member 1760 comprises a length between about 12 inches and about 28 inches. In certain embodiments, member 1760 comprises a length of 24 inches.

Members 1720, 1730, 1740, 1750, and 1760, are formed from one or more rigid materials selected from the group consisting of wood, metal, plastic, and combinations thereof. In certain embodiments, a foam covering is disposed around member 1750 and/or member 1760.

In the illustrated embodiment if FIG. 17, tubular member 1710 is slidingly disposed over tubular member 210 (FIG. 2A). In certain embodiments tubular member 210 comprises a square cross-section having an outer dimension 1520. In these embodiments, tubular member 1710 comprises a square cross-section having an inner dimension 1510 (FIG. 15A), wherein dimension 1510 is greater than dimension 1520 such that tubular member 1710 can be slidingly disposed over tubular member 210.

In certain embodiments tubular member 210 comprises a circular cross-section having an outer diameter 1540. In these embodiments, tubular member 1710 comprises a circular cross-section comprising an interior diameter 1530 (FIG. 15B), wherein diameter 1530 is greater than diameter 1540 such that tubular member 1710 can be slidingly disposed over tubular member 210.

Figure 19A:
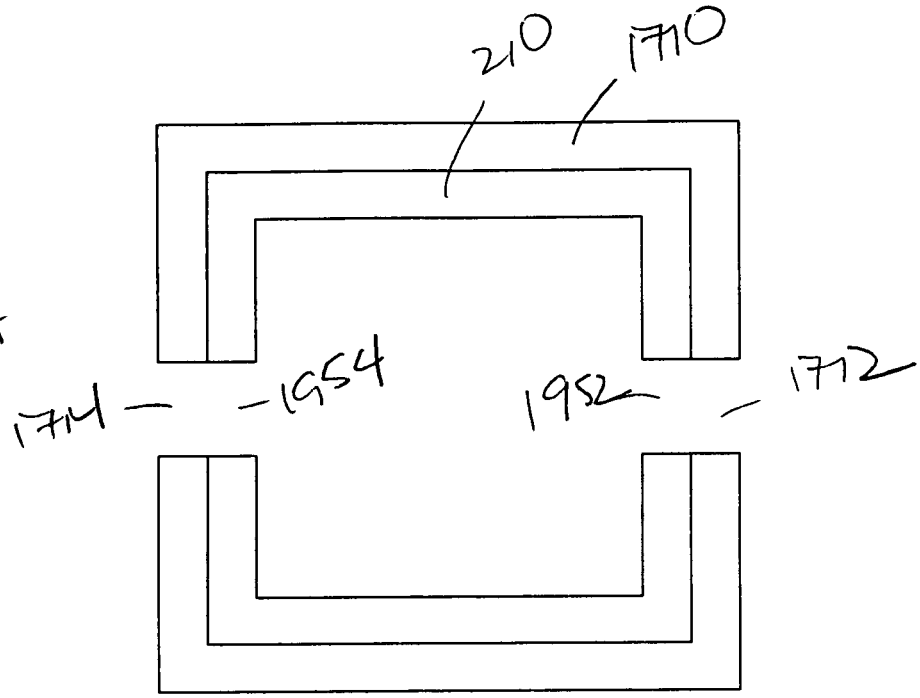
Figure 19B:
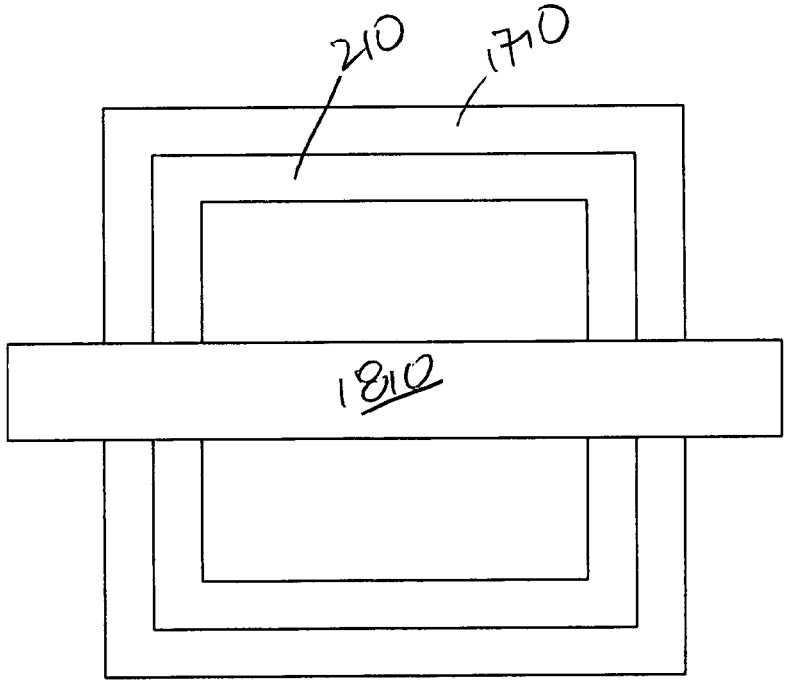

Referring now to FIGS. 17, 19A, and 19B, tubular member 1710 is formed to include aperture 1712 extending therethrough. Tubular member 1710 is formed to further include an opposing aperture 1714 extending therethrough. Tubular member 210 is formed to comprise opposing apertures 1952 and 1954 extending therethrough. In the illustrated embodiment of FIG. 17, tubular member 1710 is slidingly positioned such that apertures 1712 and 1552 are aligned, and such that apertures 1714 and 1554 are aligned, such that securing member 1810 (FIGS. 18, 19B) can be removeably extended through apertures 1712 and 1714 in tubular member 1710 and through corresponding apertures 1952 and 1954 in tubular member 210 to releaseably secure tubular member 1710 to tubular member 210.

Figure 20:
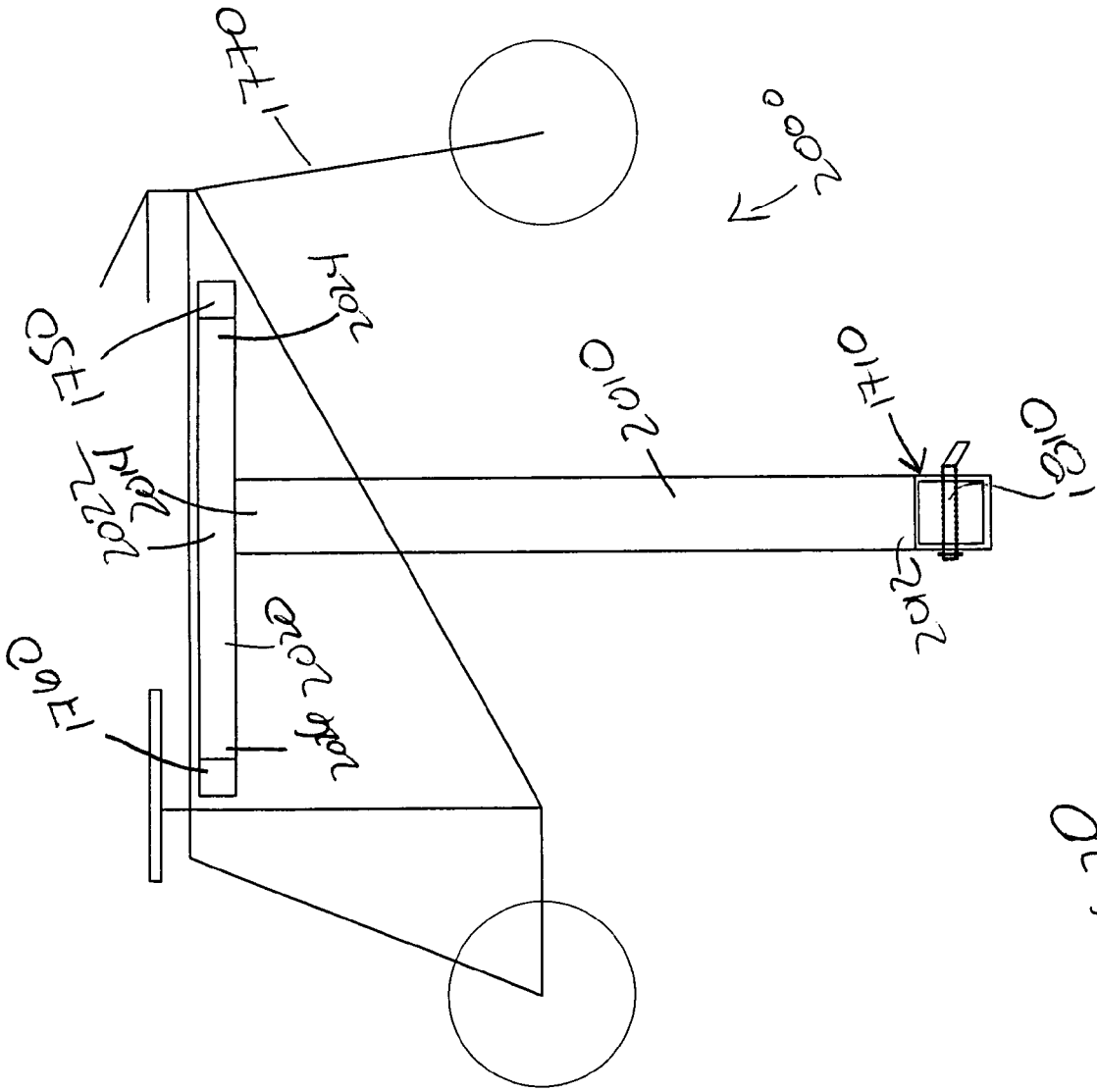
FIG. 20 shows a front view of a second embodiment of Applicant's bicycle rack.

FIG. 20 shows a second embodiment of Applicant's bicycle rack assembly. Bicycle rack assembly 200 comprises tubular member 1710 and locking pin 1810 in combination with vertical member 2010 and horizontal member 2020. First end 2012 of vertical member 2010 is attached to tubular member 1710, and second end 2014 extends upwardly from tubular member 1710. Vertical member 2010 is formed from one or more rigid materials, such as for example wood, metal, plastic, and combinations thereof. In certain embodiments, vertical member 2010 has a length between about 24 inches and about 48 inches. In certain embodiments, vertical member 2010 has a length of 36 inches.

Horizontal member 2020 comprises a midpoint 2022, a first end 2024, and a second end 2026. Horizontal member 2020 is attached at midpoint 2022 to end 2014 of vertical member 2010, with ends 2024 and 2026 extending outwardly from vertical member 2010 in both directions. Member 1750 (FIGS. 17, 18) is attached to end 2024 of horizontal member 2020 and extends outwardly therefrom. Member 1760 (FIG. 18) is attached to end 2026 of horizontal member 2020 and extends outwardly therefrom. Bicycle 1770 is supported by members 1750 and 1760.

While the preferred embodiments of the present invention have been illustrated in detail, it should be apparent that modifications and adaptations to those embodiments may occur to one skilled in the art without departing from the scope of the present invention as set forth in the following claims.

I claim:

1. An adjustable portable table assembly which can be releaseably attached to a vehicle, comprising:

a horizontal assembly comprising a first tubular member having a first end and a second end, wherein said first end of said first tubular member-can be releaseably attached to said vehicle a second member comprising a first end and a second end, wherein said first end of said second member is slidingly disposed within said second end of said first tubular member; a first fixturing means capable of releaseably attaching said second member to said first tubular member; wherein the length of said horizontal assembly can be adjusted by increasing or decreasing the length of said second member inserted into said first tubular member;

a tubular vertical assembly having a diameter, wherein said tubular vertical assembly comprises a first open end and a threaded second open end, wherein said second end of said second member is attached to said vertical assembly adjacent said first open end;

a table comprising a top surface, a bottom surface, and an attachment plate attached to said bottom surface, wherein said attachment plate comprises a threaded first aperture extending therethrough, and wherein said table is formed to include a second aperture having said diameter extending therethrough, wherein said table can be releaseably attached to said vertical assembly by engaging the threaded second open end of said tubular vertical assembly with said threaded first aperture;

a second tubular member slidingly disposed around said first tubular member;

a first storage container comprising a bottom, a first wall, and an opposing second wall, attached to said bottom of said first storage container and extending upwardly therefrom;

an attachment band comprising a first end and a second end, wherein said first end of said attachment band is attached to said first wall, and wherein said second end of said attachment band is attached to said second wall, and wherein said bottom of said first storage container is disposed on a top surface of said second tubular member, and wherein said attachment band passes under a bottom surface of said second tubular member.

2. The portable table assembly of claim 1, wherein said first storage container further comprises a top hingedly attached to one of said one or more walls.

3. The portable table assembly of claim 1, further comprising a second storage container attached to said second tubular member.

4. The portable table assembly of claim 3, wherein:

said second storage container comprises a second storage container length and a second storage container width;

said table comprises a table diameter and a table thickness;

said second storage table length is greater than said table thickness, and said second storage container width is greater than said table diameter.

5. The apparatus of claim 1, further comprising a shelter assembly comprising an umbrella and an umbrella shaft, wherein said umbrella shaft comprises a first end and a second end, wherein said first end of said umbrella shaft is attached to said umbrella, and wherein said umbrella shaft extends through said aperture and through said vertical assembly.

6. An adjustable portable table assembly which can be releaseably attached to a vehicle, comprising:

a horizontal assembly comprising a first tubular member having a first end and a second end, wherein said first end of said first tubular member-can be releaseably attached to said vehicle a second member comprising a first end and a second end, wherein said first end of said second member is slidingly disposed within said second end of said first tubular member; a first fixturing means capable of releaseably attaching said second member to said first tubular member; wherein the length of said horizontal assembly can be adjusted by increasing or decreasing the length of said second member inserted into said first tubular member;

a tubular vertical assembly having a diameter, wherein said tubular vertical assembly comprises a first open end and a threaded second open end, wherein said second end of said second member is attached to said vertical assembly adjacent said first open end;

a table comprising a top surface, a bottom surface, and an attachment plate attached to said bottom surface, wherein said attachment plate comprises a threaded first aperture extending therethrough, and wherein said table is formed to include a second aperture having said diameter extending therethrough, wherein said table can be releaseably attached to said vertical assembly by engaging the threaded second open end of said tubular vertical assembly with said threaded first aperture;

a bicycle rack comprising:

a second tubular member slidingly disposed around said first tubular member;

a third member having a first end attached to a top surface of said second tubular member and a second end extending upwardly therefrom;

a fourth member having a first end attached to a top surface of said second tubular member and a second end extending upwardly therefrom;

fifth member comprising a first end attached to the second end of said third member and second end extending horizontally outwardly from said third member; and a sixth member comprising a first end attached to said second end of said fourth member and a second end extending horizontally outwardly from said fourth member.

7. The portable table assembly of claim 6, wherein said bicycle rack further comprising a seventh member interconnecting said third member and said fourth member.

8. The portable table assembly of claim 6, further comprising:

a foam covering disposed around said fifth member; and a foam covering disposed around said sixth member.

9. The portable table assembly of claim 6, further comprising a shelter assembly comprising an umbrella and an umbrella shaft, wherein said umbrella shaft comprises a first end and a second end, wherein said first end of said umbrella shaft is attached to said umbrella, and wherein said umbrella shaft extends through said aperture and through said vertical assembly.

10. An adjustable portable table assembly which can be releaseably attached to a vehicle, comprising:

a horizontal assembly comprising a first tubular member having a first end and a second end, wherein said first end of said first member-can be releaseably attached to said vehicle a second member comprising a first end and a second end, wherein said first end of said second member is slidingly disposed within said second end of said first tubular member; a first fixturing means capable of releaseably attaching said second member to said first tubular member; wherein the length of said horizontal assembly can be adjusted by increasing or decreasing the length of said second member inserted into said first tubular member;

a tubular vertical assembly having a diameter, wherein said tubular vertical assembly comprises a first open end and a threaded second open end, wherein said second end of said second member is attached to said vertical assembly adjacent said first open end;

a table comprising a top surface, a bottom surface, and an attachment plate attached to said bottom surface, wherein said attachment plate comprises a threaded first aperture extending therethrough, and wherein said table is formed to include a second aperture having said diameter extending therethrough, wherein said table can be releaseably attached to said vertical assembly by engaging the threaded second open end of said tubular vertical assembly with said threaded first aperture;

a bicycle rack comprising:

a second tubular member slidingly disposed around said first tubular member;

a third member having a first end attached to a top surface of said second tubular member and a second end extending upwardly therefrom;

a fourth member comprising a midpoint, a first end, and a second end, wherein said fourth member is attached at said midpoint to said second end of said third member, and wherein said first end of said fourth member extends horizontally outward in a first direction from said third member, and wherein said second end of said fourth member extends horizontally outward in a second direction from said third member;

a fifth member having a first end and a second end, wherein said first end of said fifth member is attached to said first end of said fourth member with said second end of said fifth member extending horizontally outwardly from said fourth member;

a sixth member having a first end and a second end, wherein said first end of said sixth member is attached to said second end of said fourth member with said second end of said sixth member extending horizontally outwardly from said fourth member.

11. The portable table assembly of claim 10, further comprising:

a foam covering disposed around said fifth member; and a foam covering disposed around said sixth member.

12. The portable table assembly of claim 10, further comprising a shelter assembly comprising an umbrella and an umbrella shaft, wherein said umbrella shaft comprises a first end and a second end, wherein said first end of said umbrella shaft is attached to said umbrella, and wherein said umbrella shaft extends through said aperture and through said vertical assembly.

* * * * *